US007931786B2

(12) United States Patent
Wilson et al.

(10) Patent No.: US 7,931,786 B2
(45) Date of Patent: Apr. 26, 2011

(54) APPARATUS AND METHOD FOR AGITATING LIQUIDS IN WET CHEMICAL PROCESSING OF MICROFEATURE WORKPIECES

(75) Inventors: Gregory J. Wilson, Kalispell, MT (US); Paul R. McHugh, Kalispell, MT (US); Daniel J. Woodruff, Kalispell, MT (US)

(73) Assignee: Semitool, Inc., Kalispell, MT (US)

( * ) Notice: Subject to any disclaimer, the term of this patent is extended or adjusted under 35 U.S.C. 154(b) by 1163 days.

(21) Appl. No.: 11/603,940

(22) Filed: Nov. 22, 2006

(65) Prior Publication Data

US 2007/0151844 A1 Jul. 5, 2007

Related U.S. Application Data

(60) Provisional application No. 60/739,343, filed on Nov. 23, 2005.

(51) Int. Cl.
*C25D 21/10* (2006.01)
*C25D 17/02* (2006.01)
*C25D 7/12* (2006.01)

(52) U.S. Cl. ..... 204/273; 204/272; 204/237; 366/335

(58) Field of Classification Search ..... 366/334, 366/335

See application file for complete search history.

(56) References Cited

U.S. PATENT DOCUMENTS

| | | | | |
|---|---|---|---|---|
| 3,652,442 | A | 3/1972 | Powers et al. | |
| 5,683,564 | A | 11/1997 | Reynolds | |
| 6,482,300 | B2 | 11/2002 | Sakaki | |
| 6,547,937 | B1 | 4/2003 | Oberlitner et al. | |
| 7,390,382 | B2 | 6/2008 | McHugh | |
| 7,842,173 | B2 | 11/2010 | McHugh | |
| 2001/0032788 | A1 * | 10/2001 | Woodruff et al. | 205/687 |
| 2002/0088708 | A1 | 7/2002 | Sakaki | |
| 2003/0121774 | A1 * | 7/2003 | Uzoh et al. | 204/290.01 |
| 2004/0245094 | A1 | 12/2004 | McHugh et al. | |
| 2005/0006241 | A1 | 1/2005 | McHugh et al. | |
| 2005/0034809 | A1 | 2/2005 | Woodruff et al. | |
| 2005/0050767 | A1 | 3/2005 | Hanson et al. | |
| 2005/0089645 | A1 | 4/2005 | Keigler et al. | |
| 2005/0167275 | A1 * | 8/2005 | Keigler et al. | 205/96 |
| 2007/0144912 | A1 | 6/2007 | Woodruff | |

* cited by examiner

FOREIGN PATENT DOCUMENTS

WO WO 2005042804 5/2005

OTHER PUBLICATIONS

Gregory J. Wilson and Paul R. McHugh, *Unsteady Numerical Simulation of the Mass Transfer Within a Reciprocating Paddle Electroplating Cell,* Proceedings of the 205th Meeting of the ECS, Symposium E1, Electrochemical Processing in ULS1 and MEMS, Electrodeposition, Abstract 166, San Antonio, TX (2004).

*Primary Examiner* — Harry D Wilkins, III
(74) *Attorney, Agent, or Firm* — Kenneth H. Ohriner; Perkins Coie LLP

(57) ABSTRACT

Reactors with agitators and methods for processing microfeature workpieces with such reactors. The agitators are capable of obtaining high, controlled mass-transfer rates that result in high quality surfaces and efficient wet chemical processes. The agitators generate high flow velocities in the fluid and contain the high energy fluid proximate to the surface of the workpiece to form high quality surfaces when cleaning, etching and/or depositing materials to/from a workpiece. The agitators also have short stroke lengths so that the footprints of the reactors are relatively small. As a result, the reactors are efficient and cost effective to operate. The agitators are also designed so that electrical fields in the processing solution can effectively operate at the surface of the workpiece.

25 Claims, 17 Drawing Sheets

APPARATUS AND METHOD FOR AGITATING LIQUIDS IN WET CHEMICAL PROCESSING OF MICROFEATURE WORKPIECES

CROSS-REFERENCE TO RELATED APPLICATION

This application claims benefit of U.S. Provisional Application 60/739,343, filed Nov. 23, 2005.

TECHNICAL FIELD

The present invention is related to apparatus and methods for agitating a processing solution to provide high velocity, controlled fluid flows at the surface of a microfeature workpiece that results in good mass-transfer rates, removal of bubbles or particulates, and/or high quality and high speed plating into recesses. Apparatus in accordance with the invention are suitable for cleaning, etching, depositing, and other wet chemical processes used to manufacture devices having very small features.

BACKGROUND

In many wet chemical processes, a diffusion layer forms adjacent to a process surface of a workpiece. The diffusion layer is a thin region of varying material or species concentrations adjacent to the workpiece surface, and it is often a significant factor in the efficacy and efficiency in wet chemical processing. It is created by the consumption or creation of material/species at the surface. The thickness of the diffusion layer dictates the mass-transfer rate of components/reactants to the surface, and thus the mass-transfer rate can be controlled by controlling the diffusion layer. A thinner diffusion layer, for example, results in a higher mass-transfer rate. It is accordingly desirable to control the mass-transfer rate at the workpiece to achieve the desired results. For example, many manufacturers seek to increase the mass-transfer rate to increase the etch rate and/or deposit rate for reducing the length of the processing cycles. The mass-transfer rate also plays a significant role in depositing alloys onto microfeature workpieces because the different ion species in the processing solution have different plating properties. Therefore, increasing or otherwise controlling the mass-transfer rate at the surface of the workpiece is important in depositing alloys and other wet chemical processes.

One technique for increasing or otherwise controlling the mass-transfer rate at the surface of the workpiece is to increase the relative velocity between the processing solution and the surface of the workpiece, and in particular flows that impinge upon the workpiece (e.g., non-parallel flows). Many electrochemical processing chambers use fluid jets or rotate the workpiece to increase the relative velocity between the processing solution and the workpiece. Other types of vessels include paddles that have blades which translate or rotate in the processing solution adjacent to the workpiece to create a high-speed, agitated flow at the surface of the workpiece. In electrochemical processing applications, for example, the paddles typically oscillate next to the workpiece and are located between the workpiece and an anode in the plating solution.

The foregoing techniques improve the mass-transfer rate, but they may not provide sufficient mass-transfer properties for many applications. Even existing paddle-type plating tools with a series of parallel blades do not achieve sufficiently high flow velocities to adequately reduce the thickness of the diffusion layer at the surface of the workpiece in many applications. The present inventors previously developed a plating system having a series of parallel blades in which the space between the blades is completely open such that there is direct line of sight between the wafer and the anode throughout the space between the blades. The present inventors discovered that such systems may not achieve the desired flow velocities at the wafer surface for a given blade height because the agitated flows induced by the motion of such blades dissipate away from the workpiece via the open spaces. As a result, the mass transfer rate in such open-type paddle plating tools is limited.

This problem of open-type paddle plating tools significantly impairs the efficacy of such tools for plating alloys that require significant mixing to provide a desired mass-transfer rate of the ions at the workpiece. In plating alloys, the ions of one alloy element will typically have a different plating rate or bulk concentration than the other such that the alloy element having the higher plating rate may be depleted from the diffusion layer and/or more of the alloy having the higher bulk concentration will plate onto the wafer. This results in a plated layer that does not have the desired composition of alloy elements and/or is not uniform. Moreover, this problem is particularly noticeable in plating alloys or other materials into high aspect ratio features that require recirculation within the features for optimal plating results.

Existing paddle plating tools also have several other drawbacks. For example, in many existing systems the fluid flows created by the paddles do not occur in a consistent pattern across the face of the workpiece. Additionally, rotating paddles are generally not desirable in many applications because the relative velocity between a rotating paddle and the workpiece varies as a function of the radius of the paddle such that it may be difficult to accurately control radial variations in the diffusion layer at the surface of the workpiece. These problems further limit the utility of existing paddle-type plating tools in many applications.

An additional challenge of systems that hold the wafer horizontally and linearly reciprocate the paddle horizontally is that they may require large footprints to accommodate the horizontal stroke length of the paddle. In reciprocating paddle reactors, a single paddle or multiple paddle elements are reciprocated along a linear path relative to the workpiece. This may require a significant amount of lateral horizontal space within a processing tool. As a result, reactors for processing 200 mm and 300 mm wafers with horizontal reciprocating paddles are relatively large and occupy a large footprint in a tool. This is a significant drawback because floor space in fabrication lines is expensive and the operating cost of a tool is often assessed by the number of wafers that are processed per hour per unit of floor space. As a result, many conventional horizontal reciprocating paddle reactors do not efficiently use the available space within a tool.

Another challenge of wet chemical processes includes removing particulates from the surface of the workpiece or preventing bubbles from affecting plating results. Plating and etching processes can produce bubbles and particulates that become trapped under horizontal workpieces, and cleaning processes must remove particles that are already on the wafer. Many conventional systems address this challenge by inhibiting bubbles and particulates from reaching the surface of the workpiece. If particulates or bubbles become trapped under a workpiece, then flows parallel to the workpiece are required to dislodge them from the workpiece. However, it is difficult to get both a parallel flow to remove particulates and/or dislodge bubbles from the workpiece and a high velocity impinging flow to achieve high-mass transfer rates. Therefore, there is a need to provide high flow rates tangential to the surface of the workpiece.

Still another challenge of wet chemical processes is plating into openings, such as blind openings used in packaging semiconductor devices. In many applications, semiconductor dies are packaged by plating solder alloys or other metals into openings to form arrays of electrical connections on the exterior of the package. However, unless the parallel flows across the workpiece are sufficient to recirculate fluid in the openings, then the material may not plate into the depths of the openings. This can be particularly problematic in plating solder alloys because the ion species in the alloys will have different mass transfer limits such that one of the species may not plate as desired, as explained above. Therefore, there is also a need to provide higher tangential flow velocities at the surface of the workpiece than existing open-type paddle plating tools can achieve.

In light of the foregoing, it would be desirable to provide an apparatus and method for agitating the processing solution in a manner that provides controlled, high velocity fluid flows that can provide good control of the mass-transfer rates and/or high velocity parallel (e.g., tangential) flows at the surface of the workpiece. It would also be desirable to provide such agitation of the processing solution in a reactor having a relatively small footprint to increase the efficiency of the tool. There is also a need for a reactor that increases or otherwise controls the mass-transfer rate at the surface of the workpiece and provides a uniform electrical field at the surface of the workpiece.

SUMMARY

The present invention provides reactors and methods for processing microfeature workpieces with agitators that are capable of obtaining controlled, high velocity fluid flows that result in high quality surfaces and efficient wet chemical processes. To overcome the problems and challenges of existing systems with completely open spaces between blades of a paddle, the present inventors developed a system in which the agitators have dividers spaced apart from one another along a base that has intermediate sections or floors between the dividers. The dividers and the intermediate sections form a plurality of moveable confinements that contain the agitated flows induced by moving the dividers through the processing solution near the workpiece. More specifically, the dividers generate vortices or other high flow velocities in the fluid as the agitator oscillates adjacent to the workpiece, and the moveable confinements are structured to be moveable mixing zones, such as a plurality of moveable three-sided compartments, that confine the high energy fluid proximate to the surface of the workpiece. This enhances the ion concentration at the workpiece and surprisingly provides a more uniform pattern of mixing zones across the workpiece for forming high quality surfaces when cleaning, etching and/or depositing materials to/from a workpiece. The agitators also can have short stroke lengths so that the footprints of the reactors are relatively small. As a result, the reactors are efficient and cost effective to operate. The agitators are also designed so that electrical fields in the processing solution can effectively operate at the surface of the workpiece. Reactors with the agitators accordingly provide good surface finishes and/or high quality layers, have low operating costs, and accommodate electrochemical processing of workpieces.

Reactors in accordance with the invention can have a vessel with a flow system configured to direct a flow of the processing liquid through a processing zone so that the flow impinges against the workpiece. The reactor can also include an agitator having a base and a plurality of features spaced apart from one another across the base to form movable confinements that are open to the processing zone. The agitator is coupled to an actuator that moves the base and the features along the face of the workpiece in a manner that agitates the processing fluid at the surface of the workpiece. The base and the features advantageously confine the agitated fluid to areas adjacent to the surface of the workpiece to achieve higher flow velocities that result in better ion transfer rates and tangential flows in relatively short stroke lengths.

The base of the agitator can be a plate or another structure that provides floors between the features to form a plurality of compartments. The base can further have a plurality of apertures arranged so that there are openings in the floors between the features. The features can be dividers, such as continuous or segmented ribs, blades, or other structures, arranged in a direction transverse to the direction of the movement of the agitator. The features and the base move with each other such that the features and the base form moveable recesses, channels, troughs, or other mixing zones that can confine vortices near the workpiece. The agitator can also be porous or have apertures to allow an electrical current and/or processing solution to pass through the agitator in electrochemical applications.

In operation, a workpiece is located at a processing zone, and an actuator moves the agitator to move the base and the features such that the features shed vortices as they move proximate to the surface of the workpiece. After the features shed the vortices, the moveable confinements contain the agitated fluid in the mixing zones proximate to the surface of the workpiece. The energy imparted to the fluid, therefore, remains within the mixing zones proximate to the workpiece to create controlled, high velocity fluid flows at the surface of the workpiece. The fluid flows are generally vortices that provide high velocity fluid flow components that (a) impinge on the workpiece to promote mass-transfer and/or (b) flow tangential to the surface of the workpiece to promote shear forces for removing bubbles/particulates or plating into openings. The tangential flow causes recirculation within blind vias, trenches or other types of recessed features on a workpiece. Such tangential flows are particularly useful with long features orientated with respect to the mixing zones and deep features (e.g., vias for solder plating in which the wafer is stationary). In these applications, the recirculation within the features refreshes the ions into the features to produce better filling. To avoid producing periodic non-uniformities on the workpiece, the actuator can move the agitator non-uniformly such that the mixing zones move in a pseudo-randomized manner relative to the surface of the workpiece. Additionally, by concurrently rotating the workpiece and oscillating the mixing zones, localized effects of the mixing zones are further randomized across the surface of the workpiece in a manner that results in a uniform process in which periodic non-uniformities are eliminated or at least substantially reduced. The rotation of the workpiece also averages non-symmetries in the electric field as well.

The reactors and agitators provide several advantages for cleaning, etching and/or plating processes. First, the agitator moves both the base and the features (e.g., dividers) in a manner that effectively moves a plurality of mixing compartments in a processing zone proximate to the surface of the workpiece. This contains the trailing vortices in close proximity to the surface of the workpiece so that the energy of the vortices acts against the workpiece instead of dissipating into the much larger volume of fluid in the rest of the vessel. The agitator accordingly increases the mass-transfer rate at the surface of the workpiece. Second, the stroke length of the agitator can be relatively short to provide such results in a relatively smaller footprint. Third, the stroke length, stroke velocity, frequency, movement patterns and/or other parameters of the agitator can be controlled to increase the mixing within recessed features on a wafer and/or otherwise modulated to vary the location of the mixing zones relative to the workpiece to enhance the uniformity of the process. Reactors in accordance with the invention accordingly enable fast, high quality surfaces to be processed in a footprint that enhances both the efficacy and the efficiency of the processing tool. Fourth, the agitator can also provide a uniform or otherwise controlled electrical field at the workpiece to avoid non-uniform shadowing across the workpiece. Therefore, reactors in accordance with the invention are well suited for electrochemical processes that etch and/or plate metals, alloys, and other materials.

DETAILED DESCRIPTION

FIGS. 1-10C illustrate several embodiments of reactors and methods for wet chemical processing of microfeature workpieces. Several specific details of the invention are set forth in the following description and in FIGS. 1-10C to provide a thorough understanding of certain embodiments of the invention. One skilled in the art, however, will understand that the present invention may have additional embodiments, or that other embodiments of the invention may be practiced without several of the specific features explained in the following description.

Figure 1:
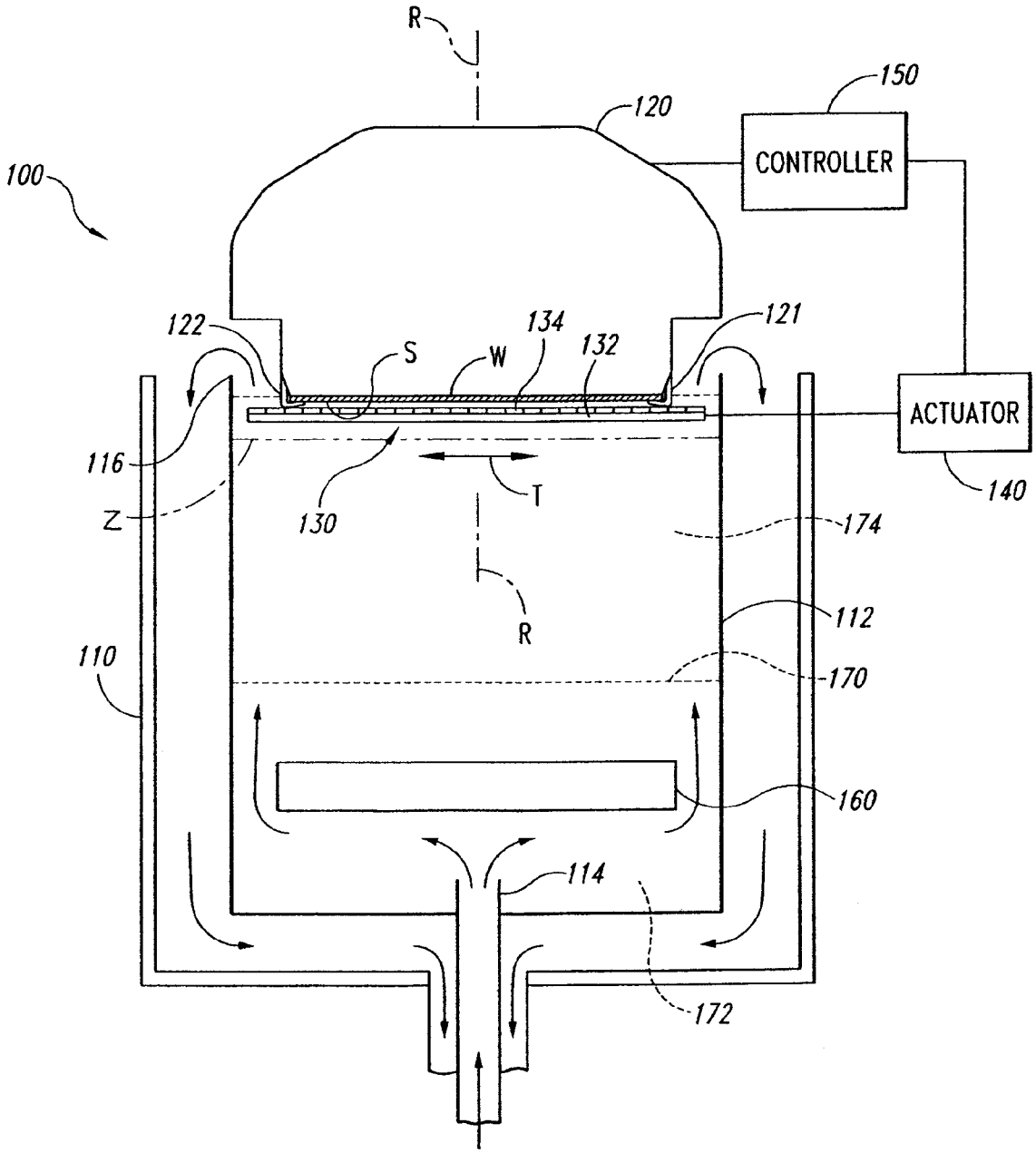
FIG. 1 is a schematic view of a reactor in accordance with an embodiment of the invention.

FIG. 1 schematically illustrates a reactor 100 for plating, etching, or cleaning a microfeature workpiece W. The reactor 100 includes a housing 110, a vessel 112 in the housing 110, and a processing zone Z in the vessel 112 through which a processing fluid can flow for processing the workpiece W. The vessel 112, for example, can be an inner vessel having a flow system with an inlet 114 that directs a flow of processing fluid relative to the processing zone Z. The vessel 112 can also include a rim 116 or weir over which the processing solution can exit the vessel 112.

The reactor 100 further includes a head assembly 120, including a workpiece holder 121 configured to hold the workpiece W in the processing zone Z. The workpiece holder 121 is configured to hold the workpiece W face down in a horizontal orientation, and the head assembly 120 can include a rotor to rotate the workpiece W about a rotational axis R. As such, the head assembly 120 is configured to place a surface S of the workpiece W in contact with a processing solution flowing through the processing zone Z. The workpiece holder 121 can further include a plurality of electrical contacts 122 configured to engage a perimeter portion of the surface S of the workpiece W. Suitable head assemblies 120, workpiece holders 121, and electrical contacts 122 are shown and described in U.S. Pat. Nos. 6,080,291; 6,527,925; 6,773,560; and U.S. application Ser. No. 11/170,557, all of which are incorporated herein by reference.

The reactor 100 can further include an agitator 130 in the processing zone Z and an actuator 140 coupled to the agitator 130. The agitator 130 is configured to provide a plurality of movable mixing zones adjacent to the surface S of the workpiece W. The agitator 130, for example, can have a base 132 and a plurality of compartments 134 spaced apart from one another across the base 132. The compartments 134 are generally configured to create vortices and/or other agitated flows in the processing solution as the actuator 140 moves the agitator 130. The compartments 134 are also generally configured to momentarily contain the agitated fluid in close proximity to the surface S of the workpiece W. These features create and contain high velocity fluid flows proximate to the surface S of the workpiece. As explained in more detail below, the compartments 134 can also be configured to refresh the fluid in the mixing zones and shape an electric field near the surface S of the workpiece W. The flow of processing solution, for example, can pass upward through the agitator 130 or along the agitator 130.

In operation, the actuator 140 moves the agitator 130 to mix the processing solution adjacent to the workpiece W. More specifically, the compartments 134 are configured to shed trailing vortices or produce other agitated flows in the processing fluid as the actuator 140 oscillates the agitator 130 along an axis transverse with respect to a longitudinal dimension of the compartments 134 (shown by arrow T). The compartments 134 generally confine the trailing vortices within the upper portion of the processing zone Z so that the energy of the trailing vortices is maintained in the processing fluid adjacent to the surface S of the workpiece W. The vortices provide high velocity fluid flow components that (a) impinge on the workpiece to promote mass-transfer and/or (b) flow tangential to the surface of the workpiece to promote shear forces for removing bubbles/particulates or plating into openings. This not only provides good control of the diffusion layer, such as generally reducing the thickness of the diffusion layer, to provide high mass-transfer rates in the mixing zones associated with individual compartments 134, but it also promotes the removal of bubbles/particulates from the surface of the workpiece. As a result, the agitator 130 and the actuator 140 can control the mass-transfer limit for plating or etching materials to/from the workpiece W and also prevent bubbles/particulates from residing under the workpiece. The agitator 130 is particularly well-suited for plating alloys into openings because (a) the mass-transfer rates can be controlled by the motion parameters of the agitator 130 to control the film quality based on the different electrical properties of the individual ion species in an alloy solution and/or (b) the shear forces of the parallel flow components of the vortices enhances the ability to plate into openings. The reactor 100 accordingly provides good film qualities and/or high plating rates for pure metals, alloys and other materials (e.g., electrophoretic resists).

The actuator 140 can oscillate the agitator 130 at a frequency and amplitude to shed the vortices in a manner that optimizes the mass-transfer rate or other process parameter at the surface S of the workpiece W. The oscillation frequency of the agitator 130 will generally depend on the configuration of the agitator 130 (e.g., the spacing and size of the compartments), the velocity/movement of the agitator 130, the proximity of the workpiece W to the compartments 134, the dimensions of the chamber, the viscosity of the processing solution, and other parameters. Suitable oscillation frequencies, for example, can be at or near the vortex shedding frequency of the specific agitator. Oscillating the agitator 130 at approximately the vortex shedding frequency enables new vortices to be generated as the previous vortices dissipate against the workpiece. As such, the agitator can rapidly create and contain vortices near the surface of the workpiece W to maintain high mass-transfer rates for a significant percentage of the processing cycle.

The reactor 100 can further include a controller 150 operatively coupled to the actuator 140 and the head assembly 120. The controller 150 can include a computer-operable medium containing instructions that cause the actuator 140 to move the agitator 130 uniformly and/or non-uniformly. The instructions of the computer-operable medium, for example, can cause the actuator 140 to move the agitator along a first stroke length and then a second stroke length different than the first stroke length. The instructions of the computer-operable medium can also move the agitator along a first stroke length at a first velocity and a second stroke length at a second velocity different than the first velocity either in lieu of or in addition to moving the agitator 130 along different stroke lengths. In general, non-uniform modulation of the movement of the agitator 130 alters the positions of the compartments 134 relative to the workpiece W to enhance the uniformity of the plating/etching at the surface S of the workpiece W. Such non-uniform movement of the agitator 130 can effectively randomize the locations of the high mass-transfer zones within the compartments 134 relative to the surface of the workpiece W. The controller 150 can further activate the rotor in the head assembly 120 to rotate the workpiece holder 121 to further randomize the locations of the high mass-transfer zones. The reactor 100 accordingly provides a highly uniform distribution of zones with high mass-transfer rates across the surface S of the workpiece W. The reactor 100, therefore, produces films and surfaces with excellent quality.

The reactor 100 can further include an electrode 160 in the vessel 112 for plating or electro-etching material to/from the workpiece W. In operation, an electrical potential is applied to the electrode 160 and to the electrical contacts 122. The workpiece W accordingly becomes a working electrode and the electrode 160 becomes a counter-electrode to plate or deplate material at the surface S depending upon the polarity of the electrical potentials applied to the electrical contacts 122 and the electrode 160. In electrochemical processing applications, the agitator 130 is also configured so that the electrical field can pass through the agitator 130 in a manner that controls the distribution of the electrical field relative to the workpiece W. The agitator 130, for example, can have apertures and/or be formed from a porous material. As explained in more detail below, the agitator 130 can have a plurality of elongated apertures through which the processing solution and the electrical field can pass. Such apertures can act as virtual electrodes in the processing zone Z that further control the plating/deplating at the processing surface S. Therefore, in addition to providing excellent mass-transfer characteristics, the agitator further enables consistent and controllable electrical parameters at the surface S of the wafer W.

Figure 2:
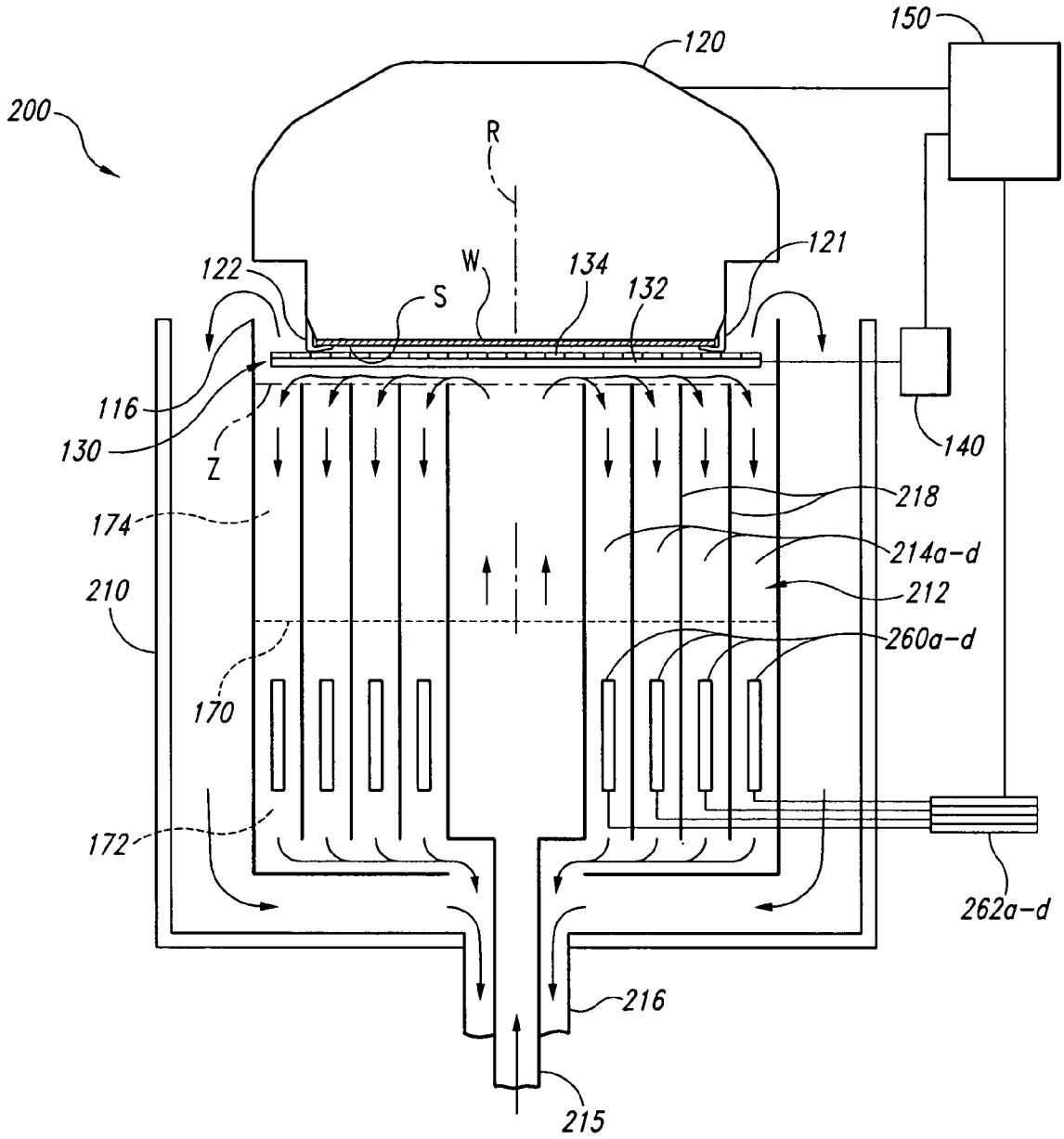
FIG. 2 is a schematic view of a reactor in accordance with another embodiment of the invention.
Figure 3A:
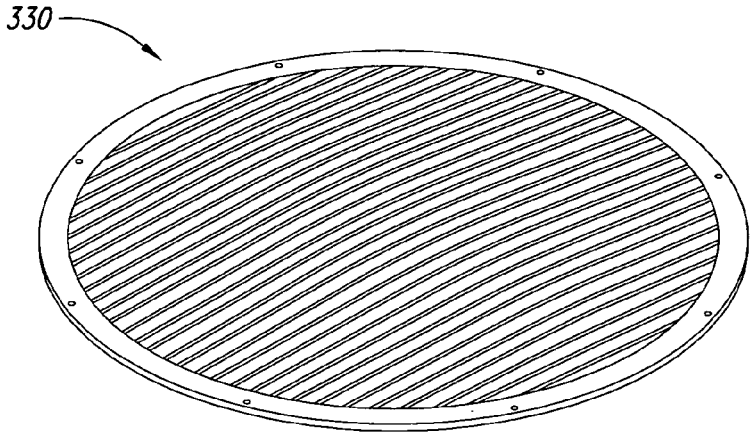
FIG. 3A is an isometric view of an agitator in accordance with an embodiment of the invention.
Figure 3B:
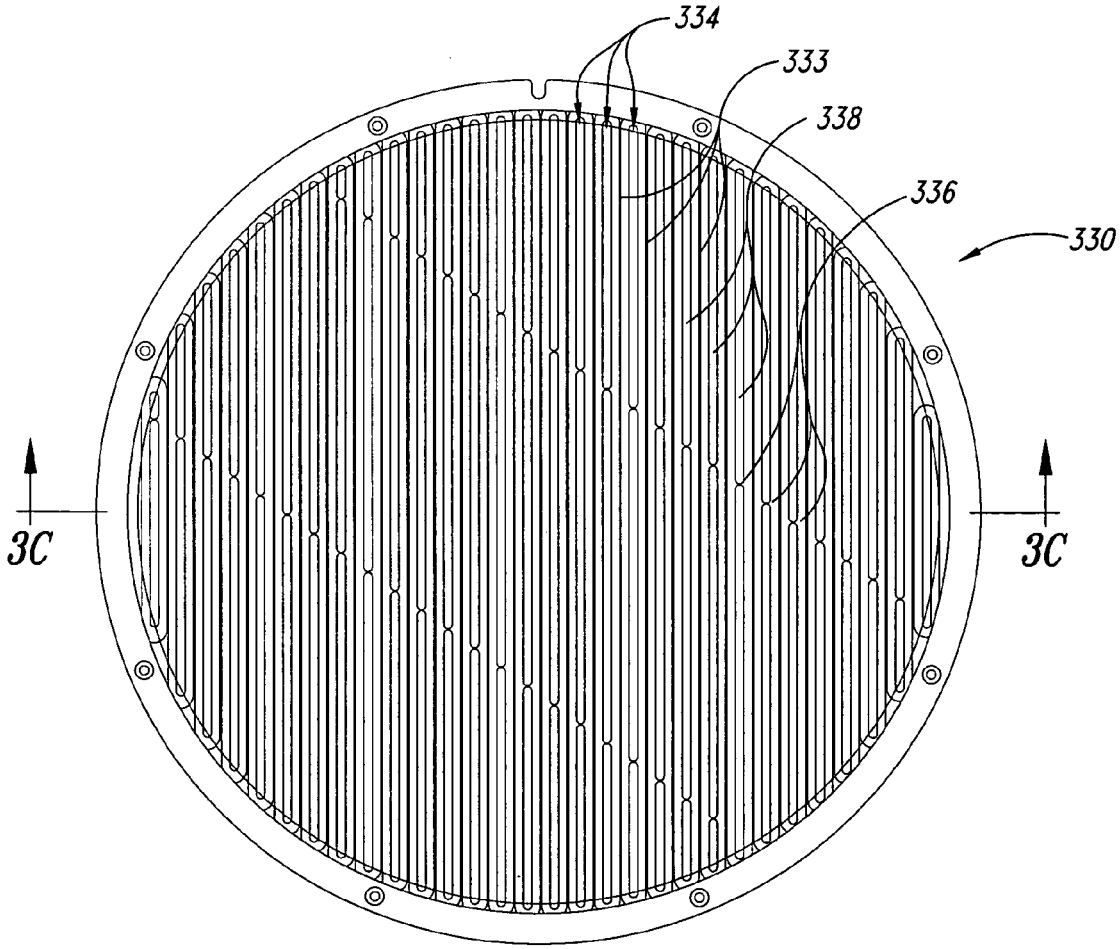
FIG. 3B is a top plan view of the agitator shown in FIG. 3A.
Figure 3C:
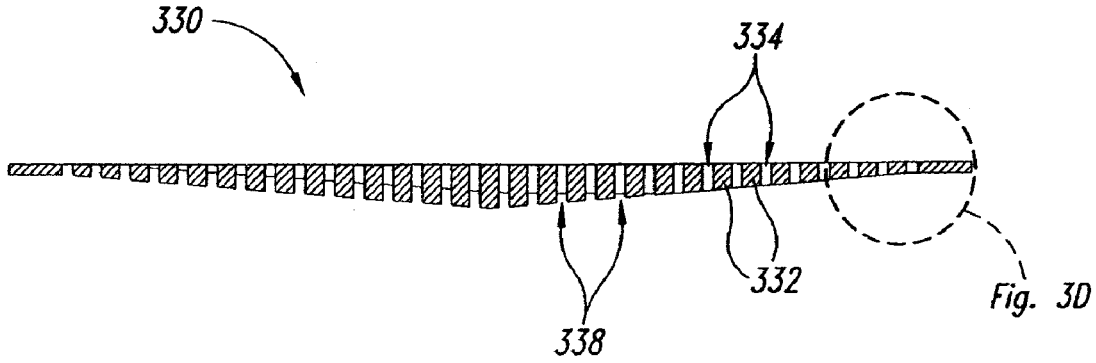
FIG. 3C is a cross-sectional view of the agitator shown in FIG. 3B taken along lines 3C-3C.
Figure 3D:
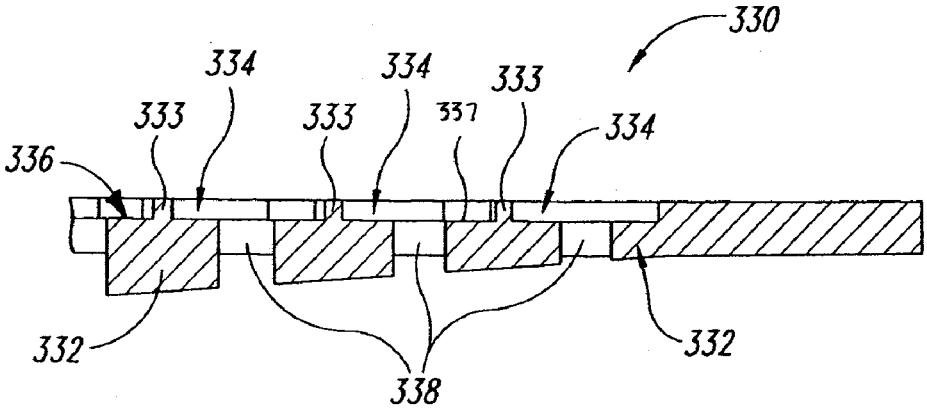
FIG. 3D is a cross-sectional view of a portion of the agitator shown in FIG. 3C.

FIG. 2 illustrates a multiple-electrode reactor 200 in accordance with another embodiment of the invention. Several components of the reactor 200 are similar to those of the reactor 100 shown in FIG. 1, and thus like reference symbols refer to like components in FIGS. 1 and 2. The reactor 200 includes a housing 210, a vessel 212 in the housing 210, and a plurality of independent electrode compartments 214*a-d* in the vessel 212. The reactor 200 also has a primary flow inlet 215 through which processing solution flows toward the processing zone Z. In the reactor 200, a portion of the processing solution flows upwardly over the rim 116 of the vessel 212, and another portion of the processing solution flows downwardly through the electrode compartments 214*a-d*. These flows can join downstream and flow out through an exit 216. It will be appreciated that the reactor 200 can have a different flow system in which the processing solution flows upwardly through the primary inlet 215 as well as the electrode compartments 214*a-d*. The electrode compartments 214*a-d* can be separated from one another by dielectric partitions 218 or walls to define a plurality of virtual electrodes proximate to the processing zone Z near the base 132 of the agitator 130. A plurality of independently operable electrodes 260*a-d* are located in corresponding electrode compartments 214*a-d*, and power supplies 262*a-d* are operatively coupled to corresponding electrodes 260*a-d*. In operation, the controller 150 includes a computer-operable medium containing instructions that cause the power supplies 262*a-d* to transmit independent electrical currents through the electrodes 260*a-d*. Suitable multiple-electrode reactors and methods for operating such reactors are disclosed in U.S. Patent Nos. 6,569,297; 7,020,537; 7,189,318; 7,160,421; 7,264,698; 7,090,751; 7,351,314; 7,351,315; 7,794,573; 7,198,694; 7,585,398and U.S. Patent Publication Nos. 2004/0099533: 2003/0038035; 2005/0034977; and 2005/0050767, all of which are incorporated herein by reference.

The reactor 200 further includes the agitator 130 in the processing zone Z between the virtual electrodes and the workpiece W. The controller 150 can operate the actuator 140 to move the agitator 130 while controlling the head assembly 120 to rotate the workpiece W about the rotation axis R. As a result, the reactor 200 can achieve the advantages of the reactor 100 with respect to the agitation of the processing solution, and also obtain the advantages of having multiple-electrodes to further control the electrical field within the reactor 200 for plating/deplating processes.

The reactor 100 shown in FIG. 1 and the reactor 200 shown in FIG. 2 can optionally include a barrier 170 in the vessel to divide the vessel into a first cell 172 and a second cell 174. The barrier 170 can be an ion-exchange membrane that allows selected ions to cross the membrane between the first and second cells 172 and 174, or the barrier can be a filter that generally limits fluid flow between the first and second cells. As a result, either an anolyte or a catholyte can be contained within the first cell 172, while the other of the anolyte or the catholyte can be contained in the second cell 174 to provide better control of the constituents in the plating solution in the second cell 174. The barrier 170, for example, can be anion selective or cation selective depending upon the particular application. Suitable examples of reactors with single or multiple anodes that include membranes are disclosed and described in several of the U.S. patent applications incorporated by reference above.

FIGS. 3A-D illustrate a specific embodiment of an agitator 330 that can be used in the reactors 100 and 200 described above. The agitator 330 can have a base 332, such as a plate or disk, and a plurality of dividers 333 spaced apart from one another across the base 332. The base 332 can be circular, rectilinear (e.g., square), oval or any other suitable shape. The dividers 333 are typically elongated ribs or blades that extend in a direction transverse (i.e., non-parallel) to the direction along which the agitator 330 is translated during processing. The dividers 333 shown in FIGS. 3A-D extend normal to the direction of movement, but the dividers 333 can have other patterns such as swept ribs, wavy and curved ribs, herringbone ribs, tire tread ribs, etc. The base 332 and the dividers 333 are configured into compartments 334 that have a first wall defined by one side of a divider 333, a second wall defined by an opposing side of an adjacent divider 333, and an intermediate section 336 between the first and second walls defined by a portion of the base 332. The intermediate sections 336 between the dividers 333 can have surfaces 337 that define floors in the compartments 334 such that the compartments 334 are three-sided channels. The intermediate section 336 can be a planar floor between the dividers 333, or the intermediate section 336 can have opposing inclined surfaces arranged in a V-shaped cross-section along a plane transverse to the longitudinal dimensions of the compartments 334 (best shown in FIGS. 5 and 6C). The agitator 330 can further include a plurality of apertures 338 through the intermediate sections 336 of the base 332. The apertures 338 are typically elongated slots that extend longitudinally in the longitudinal direction of the compartments 334, but the apertures 338 can have other configurations (e.g., circles, squares, etc.).

The shape of the base 332 and the configuration of the compartments 334 are designed to (a) provide controlled, high velocity fluid flows at the workpiece, (b) shape an electrical field in the processing zone, (c) prevent bubbles from being trapped under the agitator 330, and (d) limit the weight of the agitator to provide good acceleration performance for oscillating the agitator relative to the workpiece. The agitator 330 can have several different configurations and be made from one or more different materials. For example, the agitator 330 can be made from PEEK, titanium, porous titanium, porous ceramic, other polymers or plastics, or other suitable materials.

One example of the agitator that has been modeled by Semitool, Inc. has a thickness at the center of the base 332 of approximately 5-25 mm and a thickness at the perimeter of the base 332 of approximately 2-10 mm. The backside of the base 332 can have a generally conical shape so that bubbles under the agitator 330 migrate toward the perimeter of the agitator to prevent or otherwise inhibit bubbles from being trapped under the agitator. The agitator 330 can alternatively have a constant thickness instead of a conical profile. The base 332 of one particular example of the agitator has a thickness of approximately 10-15 mm in the center region and 2-5 mm at a perimeter region. The dividers 333 can have a height or depth of approximately 1-10 mm and be spaced apart from one another by approximately 5-25 mm across the base 332. The spacing of the dividers 333 is generally about the same as the stroke length, and thus the stroke length of the agitator 330 is approximately 5-30 mm in selected applications. One particular example of the agitator 330 has dividers with a height of approximately 1-5 mm that are spaced apart from each other by approximately 7-10 mm across the base 332.

The dividers 333 are generally designed so that they create trailing vortices within the mixing compartments 334 as the agitator is translated relative to the surface of the workpiece. Additionally, the height and spacing of the dividers 333 are designed so that the mixing compartments 334 contain the trailing vortices proximate to the process surface of the workpiece. As a result, the energy in the trailing vortices acts against the workpiece instead of dissipating into the processing solution below the agitator 330. The intermediate sections 336 and the apertures 338 can be designed to harness a significant amount of the energy of the trailing vortices within the mixing compartments 334 while also allowing a sufficient flow of processing solution to flow through the agitator 330 for refreshing the solution in the mixing compartments 334 and conducting the current of the electrical field. For plating applications, the width of the apertures 338 is a percentage of the spacing between the dividers, such as 10%-90%, 20%-50%, or approximately 30%. In cleaning applications, the agitator 330 may not have any apertures. The width of the apertures 338 may be determined by balancing the degree of containment with the extent of fluid refreshment in the compartments 334 and/or the effect on the electrical field at the wafer. For example, the apertures 338 can be about 15% of the spacing between the dividers 333 in certain plating applications.

Figure 4:
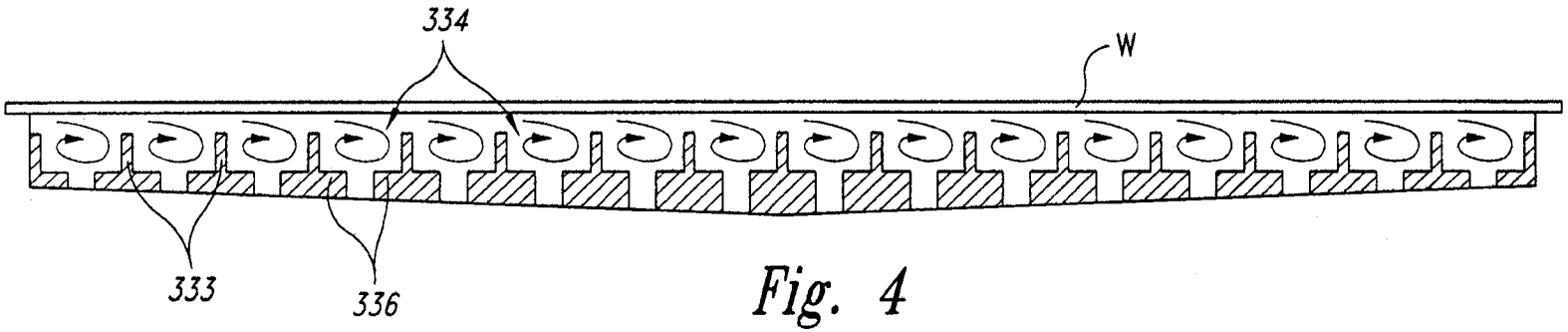
FIG. 4 is a schematic view of an agitator in accordance with an embodiment of the invention illustrating a two-dimensional flow simulation.

FIG. 4 is a schematic view of an agitator 330 illustrating a two-dimensional flow simulation. The agitator 330 is placed close to the workpiece to generate the desired fluid flows. For example, the agitator is generally positioned not more than 5 mm from the workpiece W, and more preferably about 1-2 mm away from the surface S of the workpiece W. The reciprocating motion of the agitator 330 forces a jet-like flow through gaps between the workpiece W and the dividers 333. This forms a cylindrical vortex along the longitudinal dimension of the mixing compartments 334 and creates high velocity fluid flows with parallel and impinging components across the processing surface of the workpiece W. As shown in FIG. 4, the cylindrical vortices are generally contained within corresponding compartments 334 such that the high fluid velocities of the vortices are confined in the processing zone adjacent to the surface of the workpiece W. The agitator 330 can achieve very high agitation with diffusion layers less than 20 μm or even less than 10 μm. The agitator 330 achieves this result, at least in part, because the base 332 and the dividers 333 move with each other such that the mixing compartments 334 translate relative to the workpiece W. More specifically, because the base 332 and the dividers 333 move together, the intermediate sections 336 between the dividers 333 inhibit a significant portion of the energy of the vortices from dissipating out through the agitator 330. The agitator 330 accordingly produces thin diffusion layers that result in high mass-transfer rates.

FIG. 4 further illustrates that the highest mass-transfer rates occur at nodes above the compartments 134. Accordingly, by modulating the stroke length and/or the velocity of the agitator 330, the location of the nodes can be substantially randomized relative to the workpiece to control the distribution of the mass-transfer rates across the processing surface. Additionally, the workpiece can be rotated relative to the agitator 330 to further enhance the uniformity of the mass-transfer rate distribution across the surface of the workpiece as explained above. Based on the structure and movement of the agitator 330, reactors with the agitator 330 provide exceptionally controlled, high mass-transfer rates across the surface of the workpiece. This provides better control of alloy films because ions in the processing solution are presented to the surface of the workpiece at a controlled rate to for precise deposition of an alloy composition. As a result, the agitator 330 is particularly useful for plating alloys.

Figure 5:
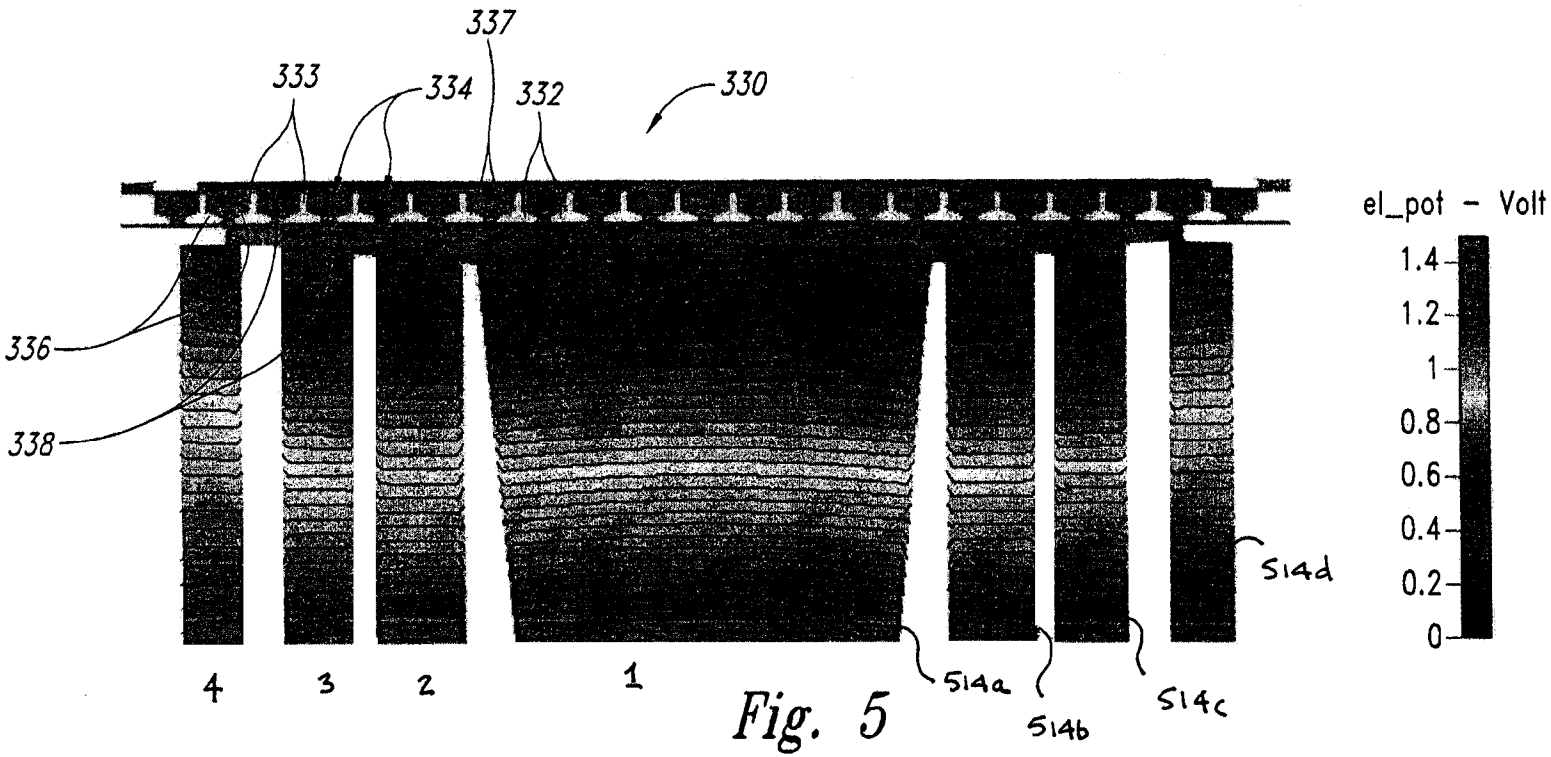
FIG. 5 is a schematic view of an agitator in accordance with an embodiment of the invention illustrating an electric field simulation.

FIG. 5 schematically illustrates an electric field generated by a plurality of electrodes in the vessel arranged similar to the electrodes 260*a-d* shown in FIG. 2. As shown in FIG. 5, the electrodes (identified as anodes 1-4) generate individual components of the electric field in individual electrode channels 514*a-d*. The aggregate electrical field reaches the base 332 of the agitator 330 and passes through the apertures 338 in the base 332. As shown in FIG. 5, the electrical field in the mixing compartments 334 is generally controlled such that the surface of the workpiece W experiences a desired distribution of current within the processing solution. The agitator 330 provides such an electrical field at the workpiece W because the agitator 330 is relatively thin such that the openings of the electrode channels 514*a-d* can be spaced relatively close to the workpiece W. Additionally, the individual apertures 338 in the agitator 330 act as small virtual electrodes proximate to the workpiece W that move relative to the workpiece. As such, the movement of the agitator 330 moves the small virtual electrodes (i.e., the apertures 338) to randomize non-uniformities across the surface of the workpiece W in a manner that provides a more uniform distribution of the electric field relative to the workpiece W. This is expected to further enhance the quality of the plating/deplating processes using the agitator 330.

Figure 6A:
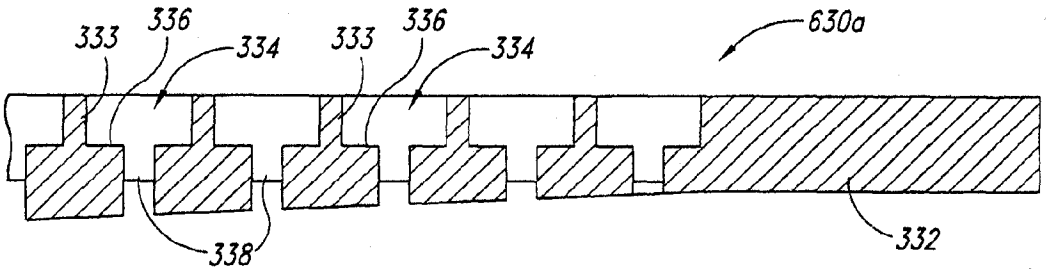
FIG. 6A is a partial cross-sectional view of an agitator in accordance with an embodiment of the invention.

FIG. 6A illustrates an agitator 630*a* in accordance with another embodiment of the invention. The agitator 630*a* is similar to the agitator 330 described above with reference to FIGS. 3A-3D, and thus like reference numbers refer to like components. The dividers 333 of the agitator 630*a* have a relatively longer length or greater height than those shown in FIG. 3D. As such, the compartments 334 of the agitator 630*a* are deeper than those of the agitator 330 shown in FIG. 3D. The height of the dividers 333 of the agitator 630*a* are well within the ranges of the dividers described above and reflect one embodiment of the agitator shown in FIG. 4. The relatively deep compartments 334 of the agitator 630*a* shown in FIG. 6A are configured to provide more processing fluid and a larger mixing zone proximate to the surface of the workpiece. As described above, the depth of the compartments is a function of several variables and can be customized for particular applications.

Figure 6B:
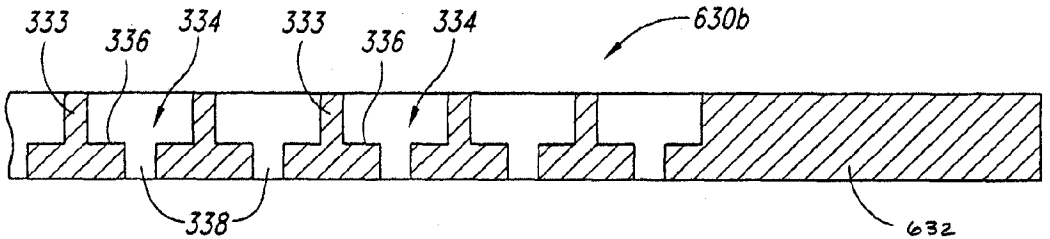
FIG. 6B is a partial cross-sectional view of another embodiment of an agitator having a flat bottom.

FIG. 6B illustrates an agitator 630*b* in accordance with still another embodiment of the invention. The agitator 630*b* is similar to the agitator 630*a*, and thus like reference numbers refer to like components in FIGS. 6A and 6B. The agitator 630*b* includes a base 632 and the plurality of dividers 333. The base 632 has a generally constant thickness instead of the conical profile of the base 332 shown above in FIG. 3C. The bottom surface of the base 632 is accordingly at least generally flat or planar such that the apertures 338 shown in FIG. 6B have uniform depths. The constant thickness of the base 632 can result in a uniform refresh rate of processing solution into the compartments 334 across the agitator 630*b*, which may enhance the ability to control the plating/etching process with greater accuracy.

Figure 6C:
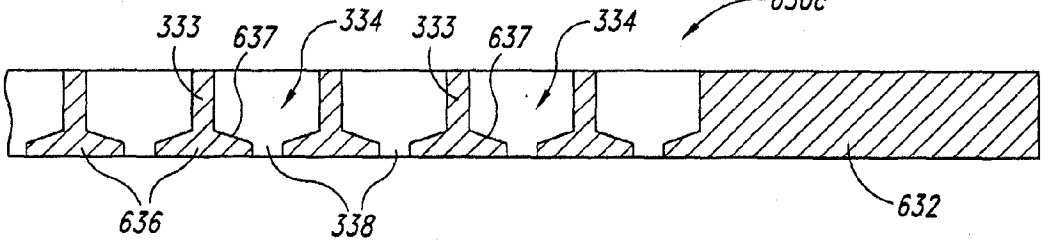
FIG. 6C is a partial cross-sectional view of yet another embodiment of an agitator having sloped intermediate sections.

Referring to FIG. 6C, an agitator 630*c* in accordance with another embodiment of the invention is shown. The agitator 630*c* has the base 632 and the dividers 333. The agitator 630*c* further includes intermediate sections 636 that have surfaces 637 which slope downward toward the apertures 338. The sloped surfaces 637 define inclined (e.g., V-shaped) floors in the compartments 334 that may enable the processing liquid to be more easily refreshed in the compartments 334. The V-shaped floors may also reduce obstruction of the vortices in the compartments.

Figure 6D:
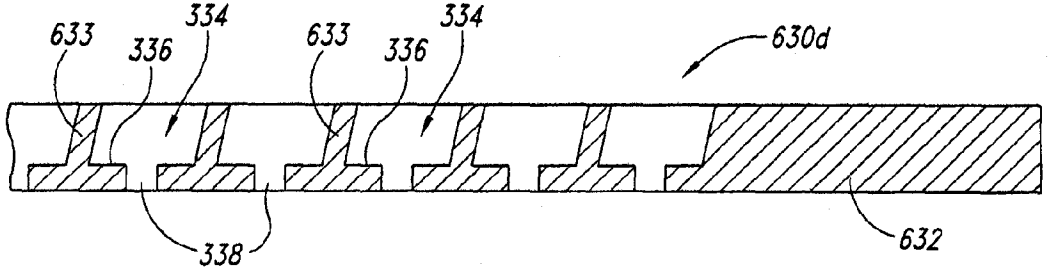
FIG. 6D is a partial cross-sectional view of another embodiment of an agitator having canted dividers.

FIG. 6D illustrates an agitator 630*d* in accordance with still another embodiment of the invention. The agitator 630*d* has the base 632 and a plurality of canted or inclined dividers 633 spaced apart from one another along the base 632. The dividers 633, more specifically, are swept relative to the top surface of the base and/or a workpiece processing plane in which the workpiece is held during processing. The dividers 633 and the intermediate sections 336 define canted compartments 334. In operation, the canted compartments 634 can create a pumping action as the agitator 630*d* reciprocates that may enhance the fluid refreshment in the compartments 634.

Figure 6E:
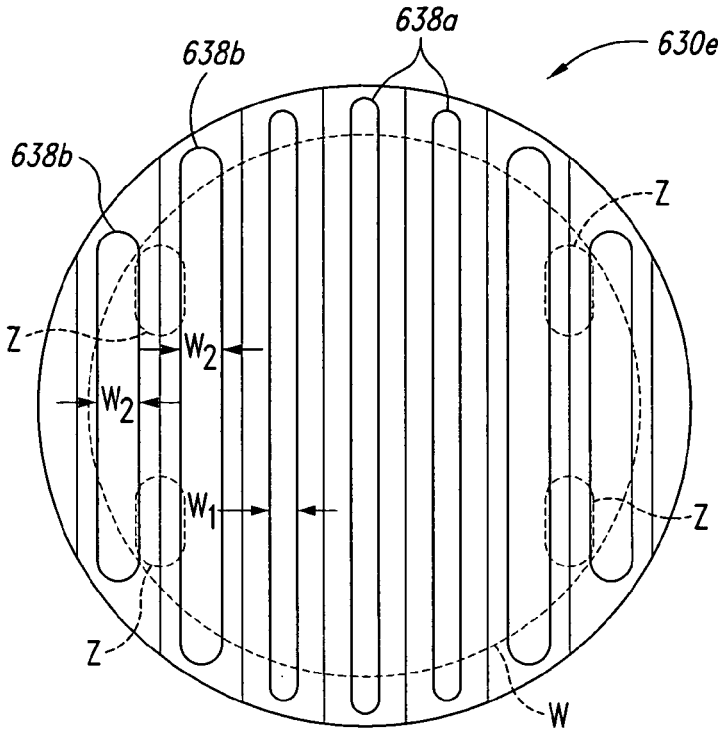
FIG. 6E is a top plan view of another embodiment of an agitator having different sized apertures.

FIG. 6E illustrates another embodiment of an agitator 630*e* that has apertures with different dimensions. The agitator 630*e* can have a base 332 or 632, any of the dividers 333 or 633, and any of the intermediate sections 336 or 636 described above. The agitator 630*e* can have first apertures 638*a* with a first width $W_1$ and second apertures 638*b* with a second width $W_2$ different than the first width $W_1$. The second apertures 638*b* can be at opposite ends of the agitator 630*e*, and in many applications the second width $W_2$ is greater than the first width $W_1$ to allow a different electrical field and/or fluid flow at the perimeter of the workpiece processing zone compared to a central region of the processing zone. Such an arrangement can be particularly useful in applications in which the workpiece is stationary during processing (e.g., solder plating or plating magnetic media). In these applications, the inventors believe several zones Z on a workpiece W may have a lower current density than other regions because of electric field interactions/disturbances created by the edge of the workpiece, shields, and the agitator. The larger second openings 638*b* can accordingly shape the electric field in these zones to compensate for such non-uniformities. Additionally, when the workpiece is rotated, localized non-uniformities can be averaged out.

Figure 6F:
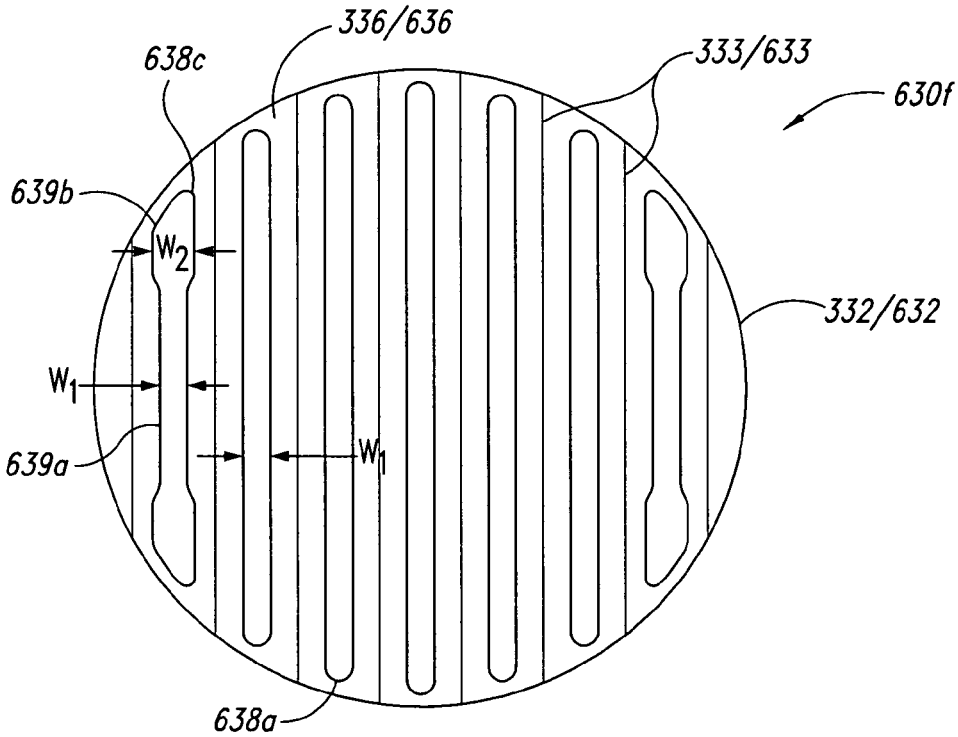
FIG. 6F is a top plan view of another embodiment of an agitator having apertures with different sized sections.

FIG. 6F illustrates another embodiment of an agitator 630*f* that has apertures with different dimensions. The agitator 630*f*, more specifically, can have one or more first apertures 638*a* as described above with reference to FIG. 6E and at least one second aperture 638*c* having a first section 639*a* with a first width $W_1$ and a second section 639*b* having a second width $W_2$. The first width $W_1$ of the first section 639*a* is generally less than the second width $W_2$ of the second section 639*b* to compensate for nonuniformities in the electric field at the perimeter of a wafer which is held stationary during processing. The agitator 630*f* can include more than one such second aperture 638*c* depending upon the particular application.

Figure 6G:
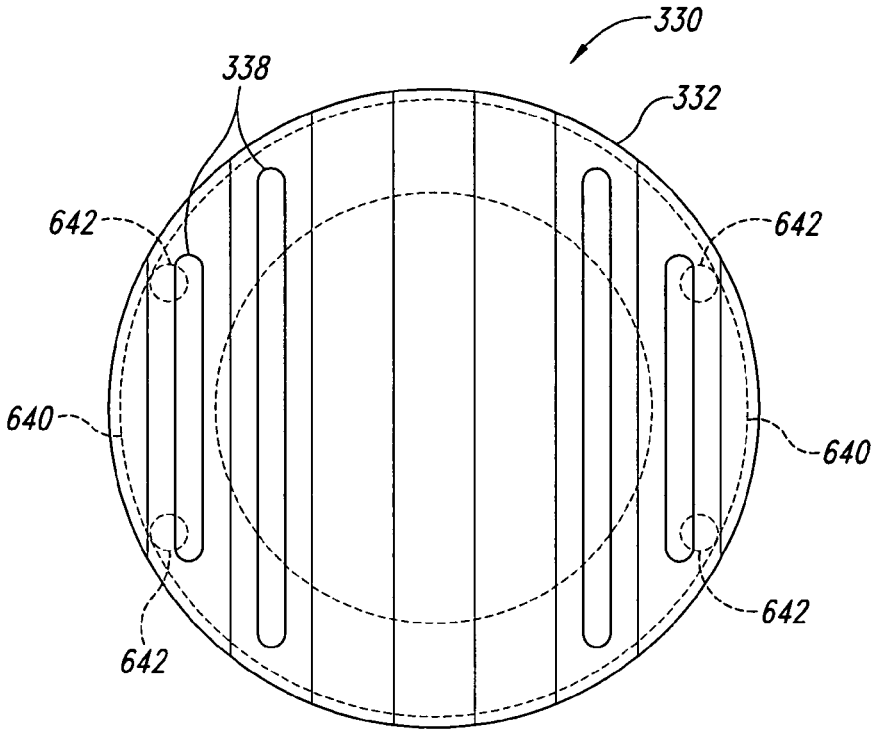
FIG. 6G is a top plan view of another implementation of an agitator in conjunction with an underlying shield.

FIG. 6G illustrates the agitator 330 described above with reference to FIGS. 3A-3D in combination with a shield 640 positioned below the agitator 330 with respect to the processing zone. The shield 640 can include a plurality of openings 642 located relative to the perimeter of the agitator 330. The openings 642 can shape the electric field to compensate for nonuniformities in the current densities in zones across the workpiece in a manner similar to the larger second opening 638*b* of the agitator 630*e* described above with reference to FIG. 6E.

Figure 6H:
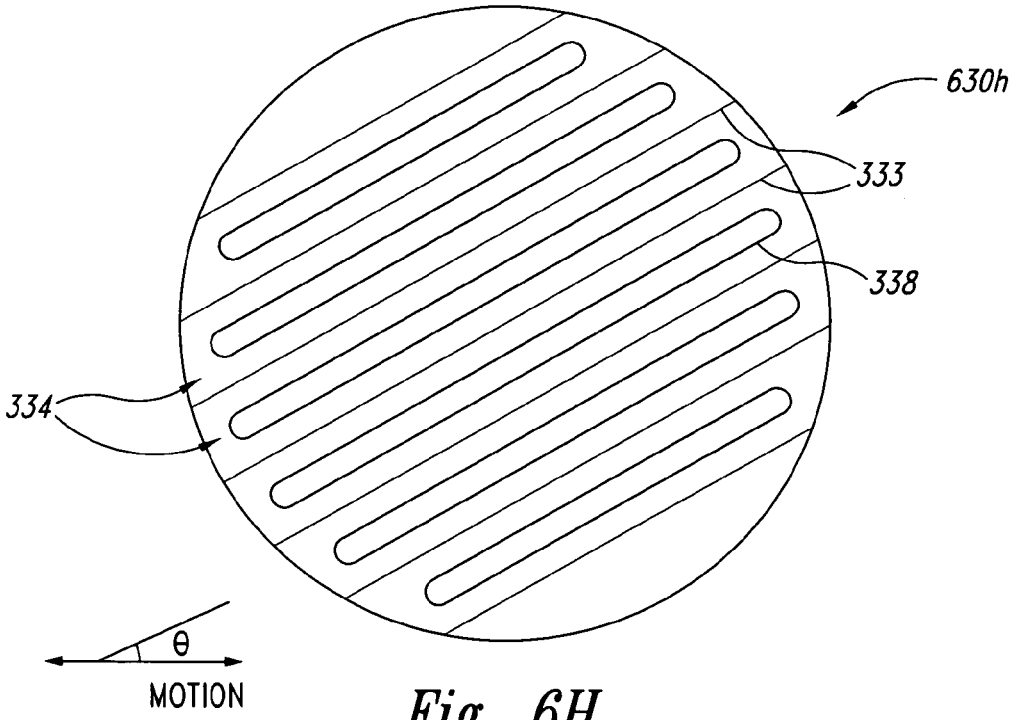
FIG. 6H is a top plan view of another embodiment of an agitator having angled dividers and apertures.

Referring to FIG. 6H, another embodiment of an agitator 630*h* in accordance with the invention is shown. The agitator 630*h* has a plurality of dividers 333 and apertures 338 that extend longitudinally at an angle Θ relative to the motion of the agitator. The dividers 333 and apertures 338 are thus swept relative to the motion of the agitator 630*h*. By sweeping the dividers 333 and the apertures 338, the vortices in the compartments 334 may also be able to flow longitudinally along the dividers 333. This may enhance the fluid refreshment in the compartments, or it may further mix the processing solution within the compartments 334.

Figure 6I:
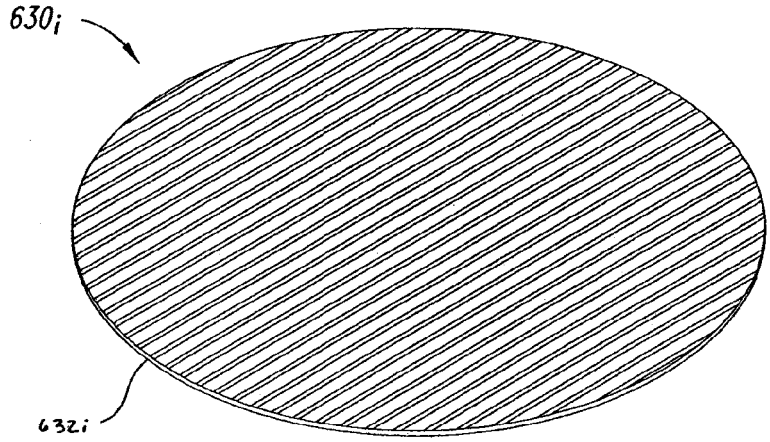
FIG. 6I is an isometric view of an agitator in accordance with another embodiment of the invention.
Figure 6J:
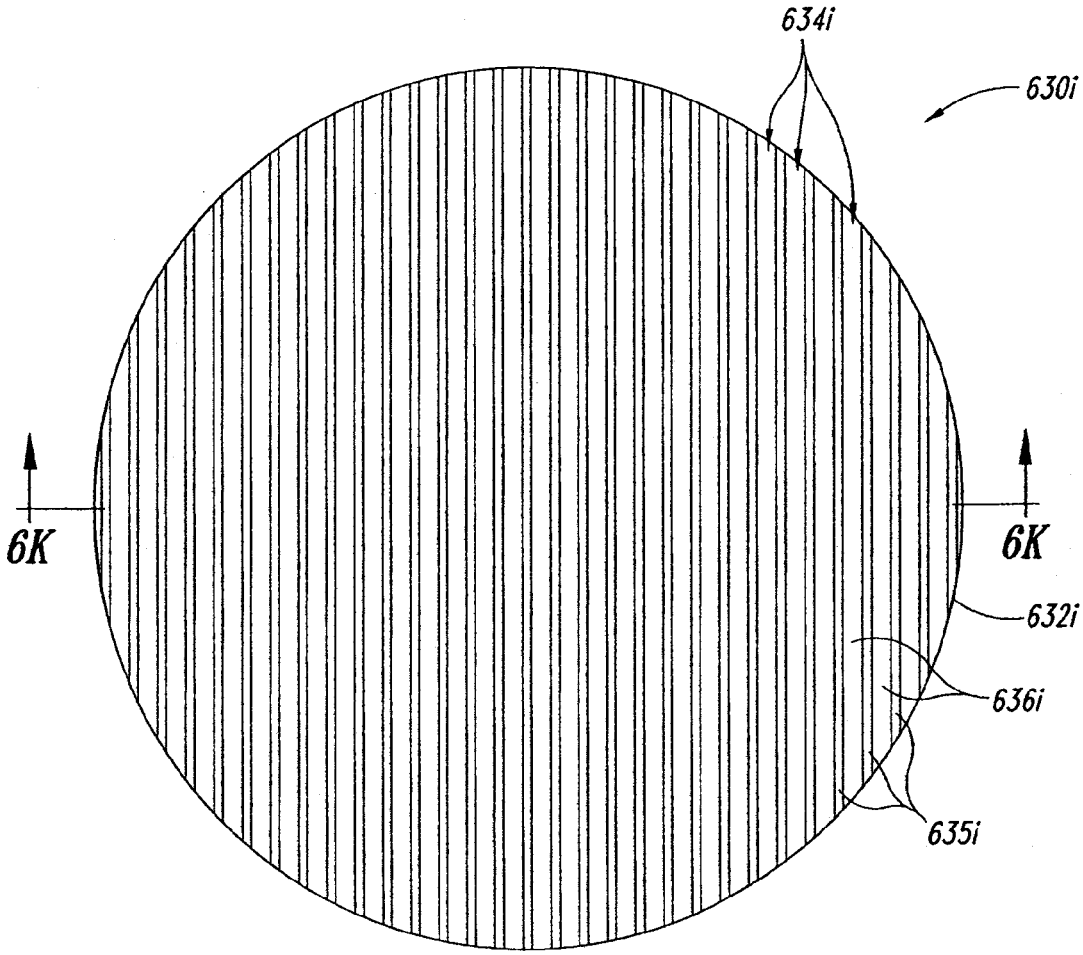
FIG. 6J is a top plan view of the agitator illustrated in FIG. 6I.
Figure 6K:
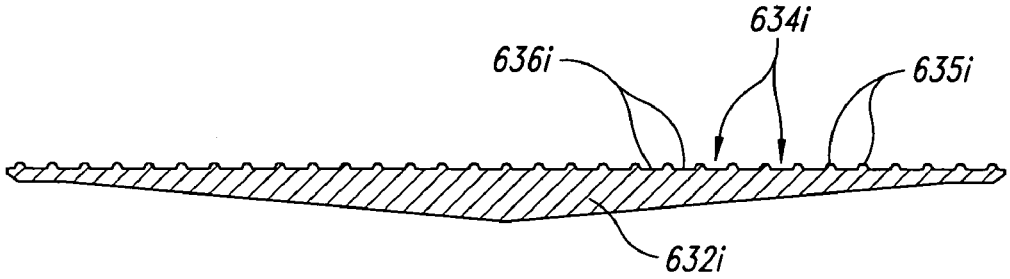
FIG. 6K is a cross-sectional view of the agitator illustrated in FIG. 6J.

FIGS. 6I-K illustrate another example of an agitator 630*i* in accordance with the invention. The agitator 630*i* has a base 632*i* composed of a porous material that is highly resistive to fluid flow, but allows the electrical current in the processing solution to pass for plating/deplating processes. The agitator 630*i* is accordingly very effective at containing the energy in the fluid flows at the workpiece. The agitator 630*i* can include a plurality of mixing compartments 634*i* separated by dividers 635*i* spaced apart from one another along the base 632*i*. The agitator 630*i* can accordingly include planar or sloped intermediate sections 636*i* between the dividers 635*i*. The difference between the agitator 630*i* illustrated in FIGS. 6I-K and the agitator 330 illustrated in FIGS. 3A-D is that the agitator 630*i* does not necessarily include apertures through the base 632*i*. Although the agitator 630*i* can include apertures as shown in the agitator 330, the porous nature of the base 632*i* allows the electrical field to pass through the agitator 630*i* without apertures.

Figure 6L:
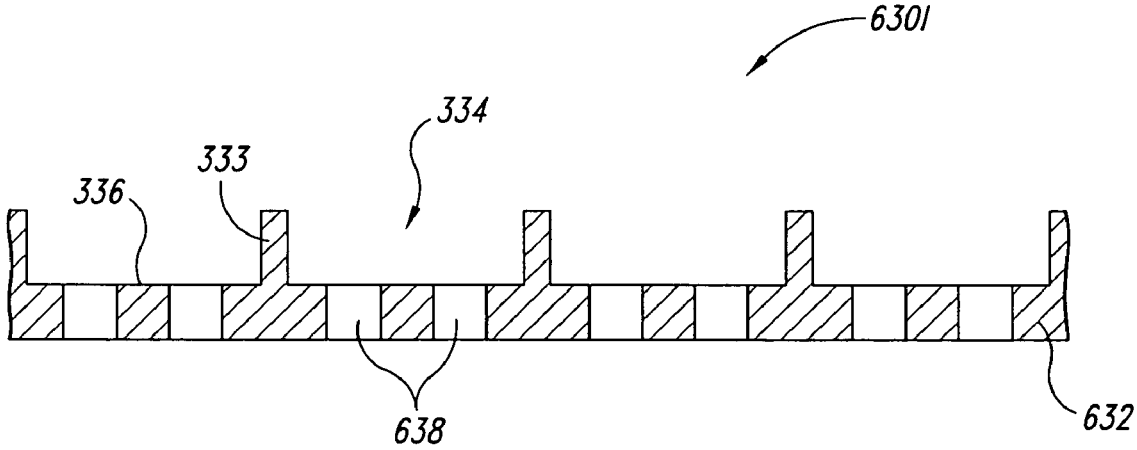
FIG. 6L is a partial cross-sectional view of an embodiment of another agitator having a plurality of apertures between dividers.

FIG. 6L illustrates an agitator 630*l* in accordance with another embodiment of the invention. The agitator 630*l* includes a base 632, a plurality of dividers 333, and intermediate sections 336 that define a plurality of compartments 334 as described above. The agitator 630*l* further includes a plurality of apertures 638 in each compartment. For example, the agitator 630*l* illustrated in FIG. 6L includes two apertures 638 through the floor of each compartment 334. The agitator 630*l* can have more than two apertures through the floor of the compartments in other embodiments. The additional apertures 638 in each compartment 334 may shape the electrical field more uniformly or provide a different fluid flow through the agitator 630*l* compared to the other embodiments of agitators.

Figure 7:
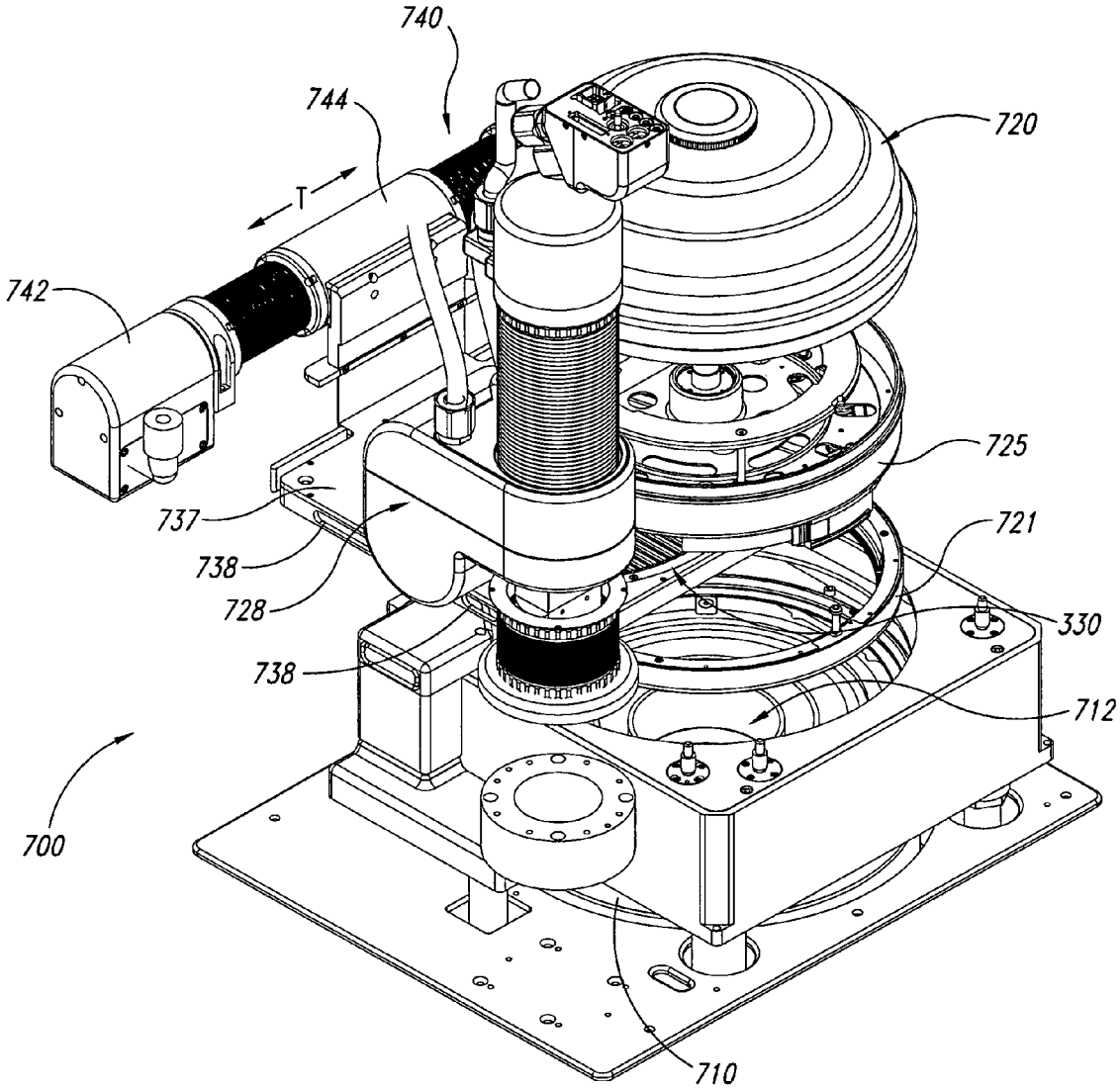
FIG. 7 is an exploded isometric view of a reactor in accordance with another embodiment of the invention.

FIG. 7 is an exploded isometric view of a specific example of a multiple-electrode reactor 700 in accordance with the invention. Several aspects of the reactor 700 are shown in specific detail to provide a further understanding of this example of the invention, but the invention is not limited to reactors having several of the specific features described below. The reactor 700 includes a housing 710 and a vessel 712 within the housing through which the processing solution can flow. The reactor 700 further includes a head assembly 720 having a workpiece holder 721 and a rotor 725 that carries the workpiece holder 721. The head assembly 720 can be attached to a lift mechanism 728 to raise/lower the head assembly 720 between a loading position and a processing position. The lift mechanism 728 can further be configured to rotate the head assembly such that the workpiece holder 721 faces upward in the loading position or downward in the processing position.

The reactor 700 further includes the agitator 330 described above with reference to FIGS. 3A-D and a platform 737 configured to carry the agitator 730. The platform 737 can include a plurality of slots 738 through which processing fluid can flow when the platform 737 and the agitator 330 are translated in an oscillatory motion (arrow T). The reactor 700 further includes an actuator 740 having a motor 742 and a carriage 744 attached to the platform 737. The motor 742 drives the carriage 744 to oscillate the platform 737 and the agitator 330. As described in more detail below, the agitator 330 and the platform 737 are positioned underneath the workpiece holder 721 to agitate the processing solution adjacent to a workpiece loaded in the workpiece holder 721.

Figure 8A:
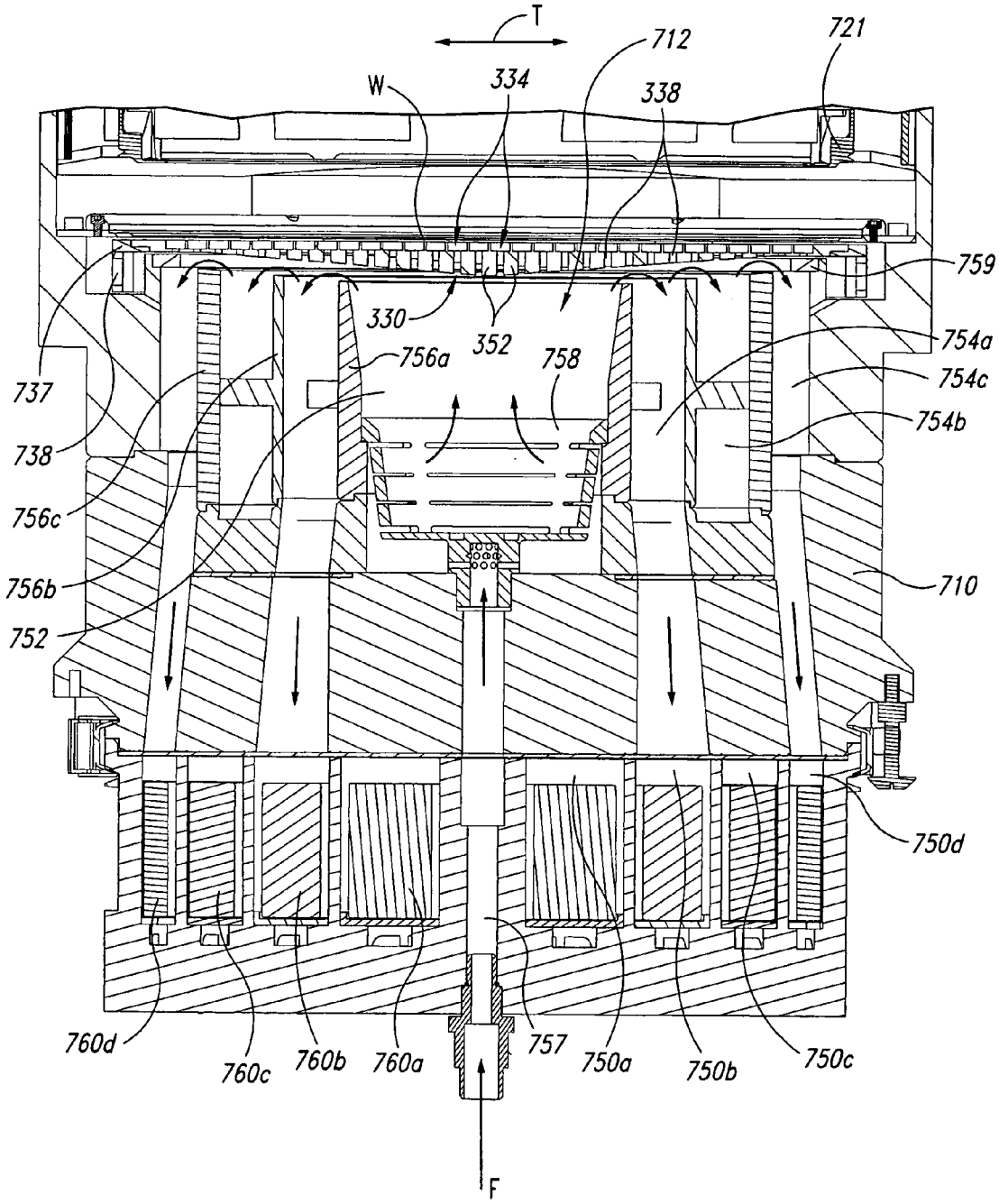
FIG. 8A is a cross-sectional view of a multiple-electrode reactor including an agitator in accordance with an embodiment of the invention.

FIG. 8A is a cross-sectional view illustrating the vessel 712 and other aspects of the reactor 700 in further detail. Like reference symbols refer to like components in FIGS. 7 and 8A. The vessel 712 can include a plurality of electrode compartments 750*a-d*, a central channel 752, and a plurality of outer channels 754*a-c*. The central channel 752 can be defined by a first wall 756*a*, and the outer channels 754*a-c* can be defined by outer walls 756*b*, 756*c*, and the housing 710. The vessel 712 can further include an inlet 757 through which a flow F of processing solution can enter the vessel 712 and a flow element 758 in the central channel 752 that conditions the flow of the processing solution. The vessel 712 can further include a shield 759 configured to obstruct a portion of the outer channel 754*c* to shield a perimeter portion of the workpiece W from the electrical field in the outer channel 754*c*. The shield 640 described above with reference to FIG. 6G can be substituted for the shield 759 shown in FIG. 7.

A plurality of electrodes 760*a-d* are located in corresponding electrode compartments 750*a-d*. More specifically, a first electrode 750*a* is in fluid communication with the central channel 752 such that the first electrode 760*a* provides a first electrical field component in the central channel 752. The second through fourth electrodes 760*b-d* are located in corresponding electrode compartments 750*b-d* and are in fluid communication with the outer channels 754*a-c*, respectively. As such, the electrodes 760*b-d* provide additional components of the electrical field that act through the channels 754*a-c*, respectively. The reactor 700 is shown with four electrodes, but the reactor 700 can have any number of two or more electrodes either with or without corresponding electrode compartments and electrode channels. The platform 737 and the agitator 330 are positioned above the openings of the central channel 752 and the outer channels 754*a-c* such that these openings act as virtual electrodes proximate to the backside of the agitator 330.

In operation, a flow of processing solution F flows through the inlet 757 and the flow element 758 to pass upwardly toward the agitator 330. A portion of the fluid flow passes through the apertures 338 in the agitator 330, while another portion of the processing solution flows downwardly through the outer channels 754*a-c*. The reverse flow over the electrodes 760*a-d* sweeps bubbles and particulates generated at the electrodes out of the vessel 712 to avoid non-uniformities on the surface of the workpiece W. The portion of the processing solution that flows through the apertures 338 is contained in the compartments 334 as the agitator 330 translates relative to the workpiece W (arrow T). The agitator 330 accordingly induces vortices or other agitated flows in the compartments 334 to enhance the processing of the workpiece W as described above.

Figure 8B:
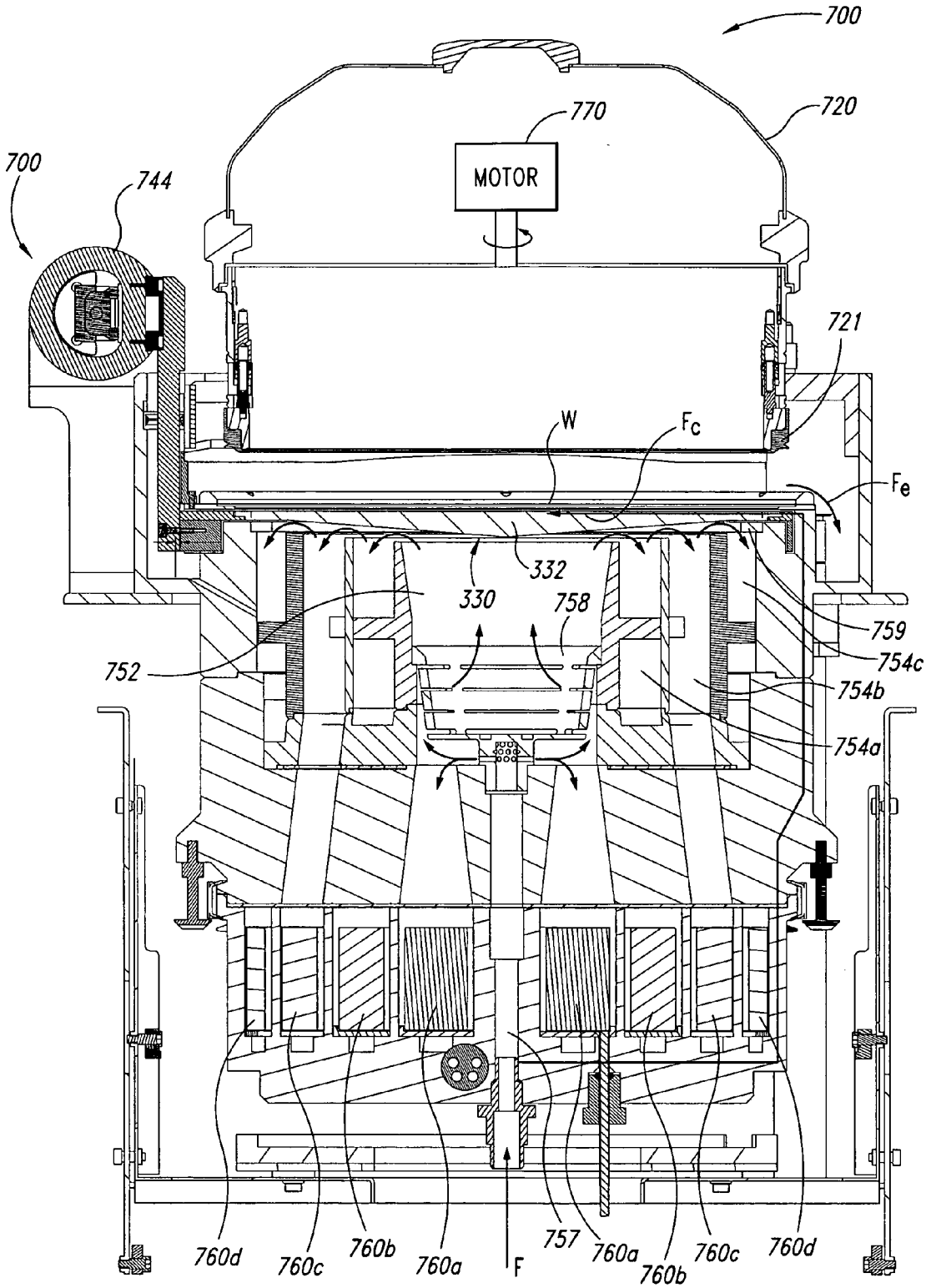
FIG. 8B is a cross-sectional view of the reactor illustrated in FIG. 8A taken along a cross-section normal to that shown in FIG. 8A.

FIG. 8B is another cross-sectional view of the reactor 700 taken at a right angle to the cross-sectional view shown in FIG. 8A. Referring to FIG. 8B, the processing solution flows through the inlet 757 and splits apart below the flow element 758 such that a portion of the processing solution flows downwardly and across the first electrode 760*a* while another portion of the processing solution flows upwardly through the flow element 758 and to the agitator 330. A portion of the flow of the processing solution that flows through the agitator 330 can exit over a rim of the vessel 712 to form an exit flow $F_e$. Another portion of the processing solution can optionally flow along the longitudinal dimension of the dividers to form a cross flow $F_c$ that refreshes the processing fluid in the workpiece processing zone. Suitable flow systems for generating such a cross flow are described in U.S. Patent No. 7,390,383, incorporated herein by reference. The reactor 700 can further include a motor 770 that rotates the workpiece holder 721 and the workpiece W relative to the agitator 330 to further distribute the high mass-transfer rates within the compartments of the agitator 330 relative to the surface of the workpiece W.

The reactor 700 achieves several of the advantages described above with reference to the reactors and agitators shown in FIGS. 1-5. More specifically, both the dividers and the base of the agitator 330 move such that the mixing compartments 334 (FIG. 8A) oscillate in the processing zone proximate to the surface of the workpiece W. As explained above, this increases the mass-transfer rate at the surface of the workpiece W because it induces trailing vortices or other agitated flows in the fluid and contains the agitated fluid proximate to the workpiece W. The reactor 700 accordingly provides good control of the plating/etching properties for producing high quality layers or surfaces. Additionally, the stroke length of the agitator 330 can be relatively short because the dividers can be spaced apart by a short distance. The reactor 700 can accordingly have a relatively small footprint such that the tool can efficiently use the available space. The stroke length and/or the stroke velocity of the agitator can also be modulated to vary the location of the mixing zones relative to the workpiece to enhance the uniformity of the process. This aspect can be further combined with rotating the workpiece holder to further distribute the mixing zones relative to the surface of the workpiece. Additionally, the agitator 330 in the reactor 700 can provide a uniform or otherwise controlled electrical field at the workpiece W to avoid non-uniform shadowing across the workpiece. Therefore, the reactor 700 enables fast, high quality surfaces to be processed in a footprint that enhances both the efficacy and the efficiency of the reactor 700.

Figure 9A:
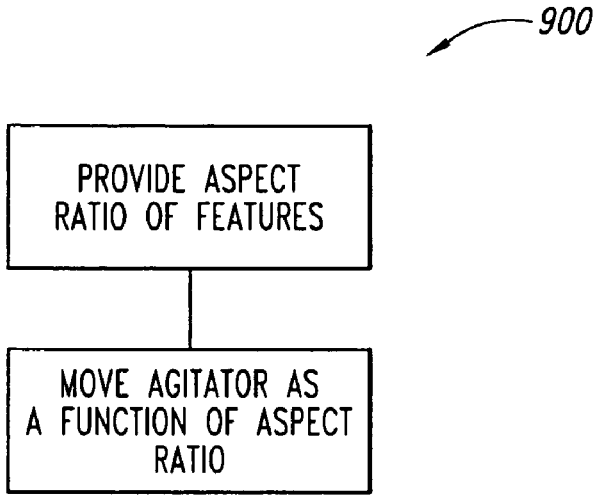
FIG. 9A is a flow chart of a method for operating a reactor in accordance with an embodiment of the invention.

FIG. 9A is a flow chart illustrating a method 900 for plating material onto a workpiece using any of the foregoing agitators and reactors. The method 900 includes providing the aspect ratio of the features and moving the agitator as a function of the aspect ratio of the features. The agitator can be moved as a function of the aspect ratio of the features to enhance the distribution of ions within the features.

Figure 9B:
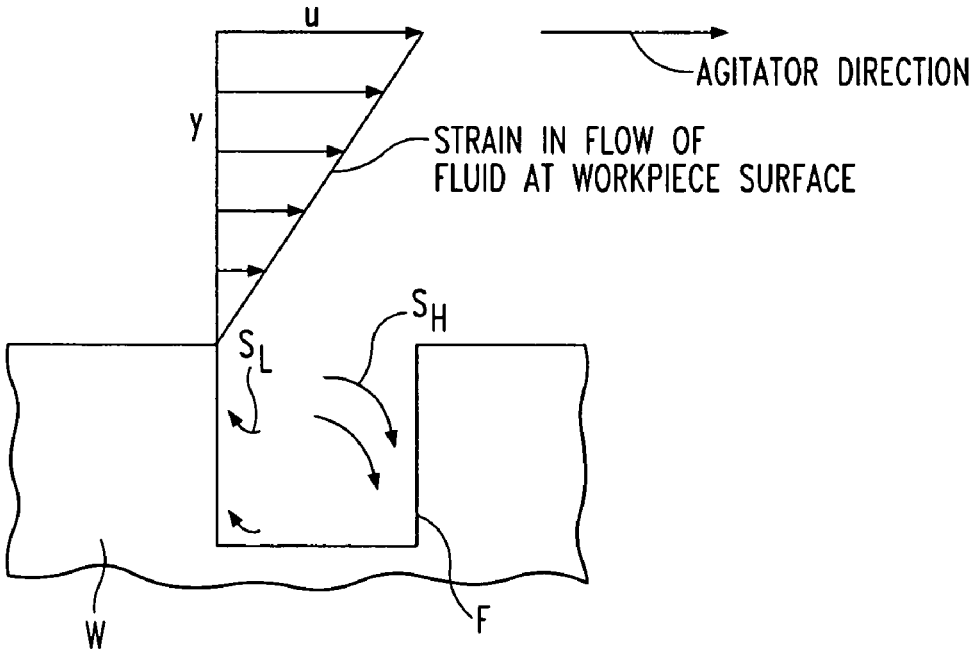
FIG. 9B is a schematic diagram illustrating strain in the fluid flow within a feature of a workpiece.

FIG. 9B, for example, schematically illustrates the strain in the fluid flow caused by the agitator within the fluid at the surface of the workpiece W and within a feature F. The strain rate in the fluid is the velocity gradient with respect to the distance from the blade of the agitator, and the slope of the plot in FIG. 9B illustrates the strain rate (du/dy). The strain in the fluid is indicative of the refresh rate of ions, and thus areas of a high strain $S_H$ will have more ions compared to those having a low strain $S_L$. The motion of the agitator can be controlled to increase the strain within the flow of fluid in the feature F and thus increase the mass-transfer of ions in the feature F compared to diffusion of ions without any fluid motion. The velocity of the agitator and the stroke length can be controlled to provide an adequate refresh rate of ions into deep features and concurrently allow a relatively steady state of ion transfer to set up within the feature. In general, higher agitator velocities increase the strain rate in a manner that increases the refresh rate and ion transfer within features. Based on modeling, recirculation in recessed features on a workpiece takes longer at lower strain rates than at higher strain rates, and mass-transfer is enhanced when a steady state of circulation is established. In general, features having a higher aspect ratio may accordingly benefit by having higher strain rates within the processing solution. As a result, the velocity of the agitator can be increased with increasing aspect ratios. Also, it may be beneficial to give adequate time for recirculation to set up, and this may be achieved by a longer stroke length for a given agitator velocity. In other applications, therefore, the motion of the agitator can be controlled to have a relatively longer stroke length at a sufficient frequency so as to provide the desired strain and recirculation in the processing fluid for a period of time. In still other applications, the motion of the agitator can also be changed during a plating process, such as reducing the velocity of the agitator as a feature fills to reduce the strain on the fluid as the aspect ratio of the feature decreases.

Figure 9C:
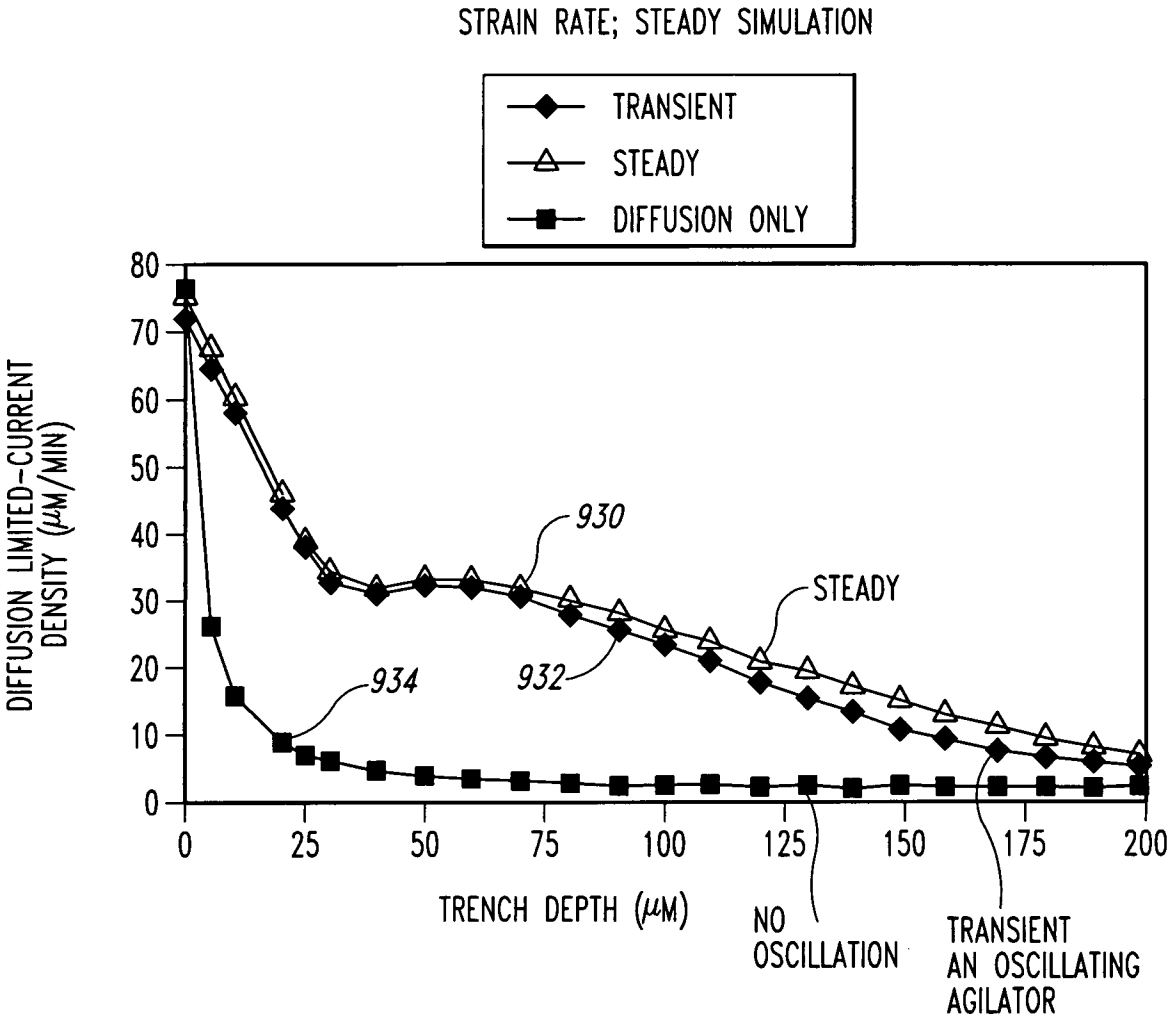
FIG. 9C is a graph illustrating the diffusion limited-current density relative to the trench depth for different levels of strain in the fluid flow.

FIG. 9C is a graph illustrating the advantage of increasing the strain in the processing fluid to plate into features. In this graph, the diffusion limited current density is related to the number of ions in the trenches, and thus a higher current density is indication of better ion transfer rates in the feature. As shown in FIG. 9C, line 930 represents a steady state flow having a first strain level, line 932 represents a transient flow similar to that provided by the foregoing agitators having a second strain approximately double the first strain, and line 934 represents a stationary flow that relies on only diffusion for ion transfer. The transient strain case in FIG. 9C is a sinusoidal applied boundary condition such that the average applied strain is equal to the stead state applied strain. The high strain in the fluid for the transient line 932 results in a significantly higher diffusion limited-current density than the stationary flow 934 and approximates the steady state flow 930. By increasing the strain in the fluid using the agitator, the higher strain rate results in a significant increase in ion transfer within deep features having depths of 50 to 200 microns. As a result, the agitator can achieve a high mass transfer equivalent to a high steady state stream induced by a cross-flow or jets without the difficulties of achieving a uniform process across the workpiece that are associated with cross-flows and jets.

Figure 10A:
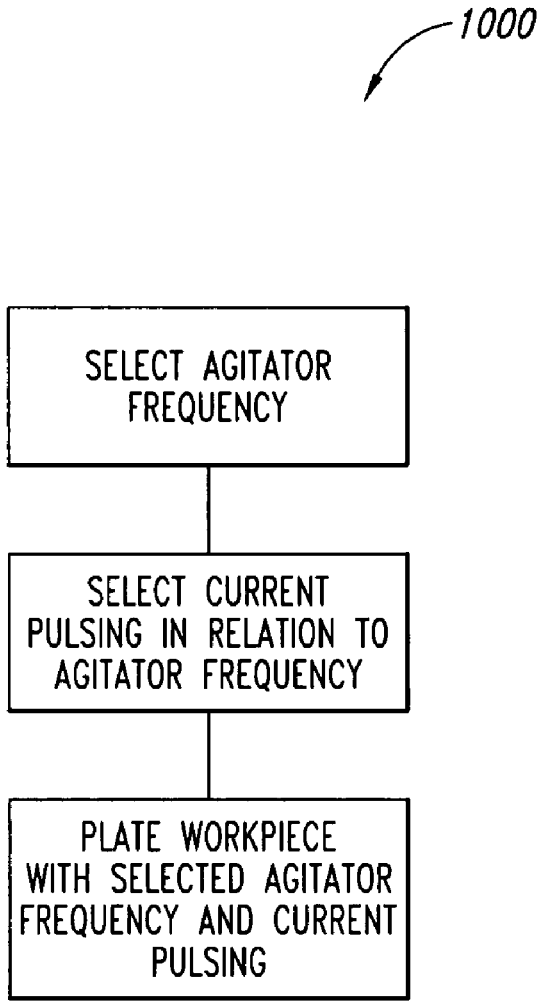
FIG. 10A is a flow chart illustrating a method for operating a reactor in accordance with another embodiment of the invention.

FIG. 10A is a flow chart illustrating a method 1000 for operating the agitator in conjunction with the pulses of current applied to the electrode(s) of the reactor. The method 1000 can include selecting an agitator frequency, selecting a current pulsing in relation to the selected agitator frequency, and plating the workpiece with the selected agitator frequency and current waveform applied to the electrodes. It will be appreciated that the current pulsing can be selected before the agitator frequency such that the agitator frequency is a function of, at least in part, the current pulsing.

In a separate embodiment, the method 1000 shown in FIG. 10A and be combined with the method 900 in FIG. 9A. This method includes providing the aspect ratio of the features, moving the agitator as a function of the aspect ratio of the features, and applying electrical current pulses to a working electrode and one or more counter electrodes in relation to the aspect ratio and/or the movement of the agitator. Different electrical pulses can be applied to different electrodes, and the electrical pulses applied to the electrodes can change dynamically during the plating process. Additionally, an outer counter electrode can be biased at a different polarity that other counter electrodes to act as a thief or source depending upon the application.

Figure 10B:
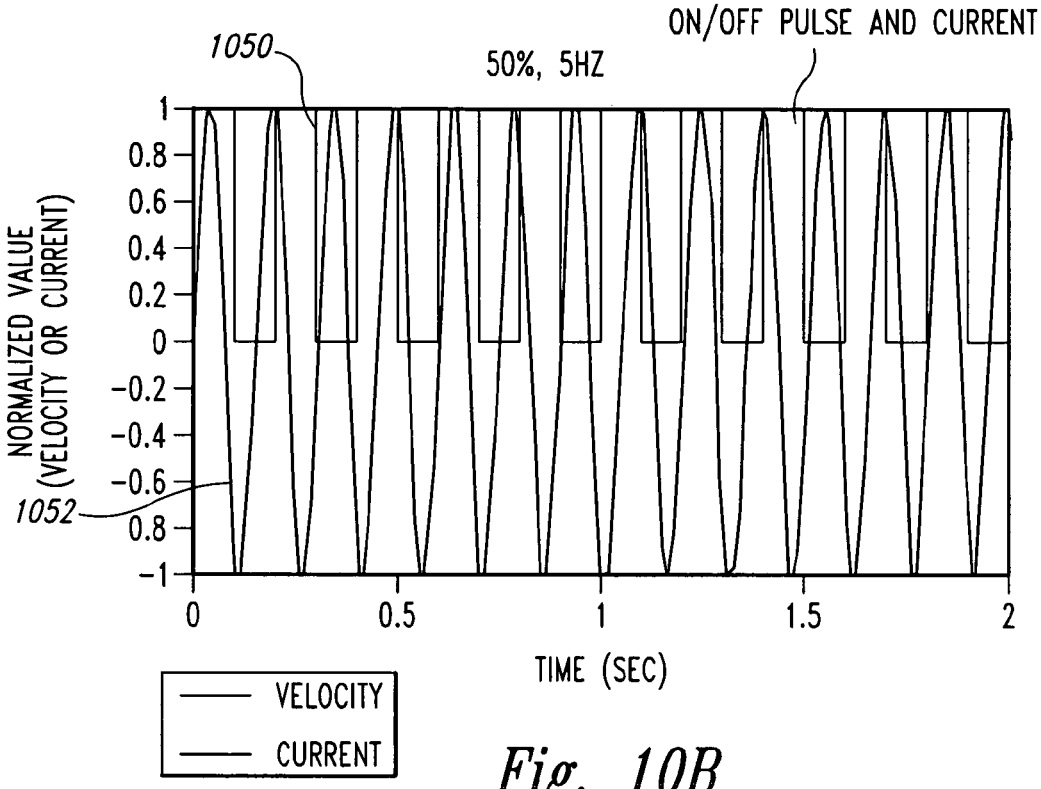
FIG. 10B is a graph illustrating an example of current pulsing in relation to agitator motion.
Figure 10C:
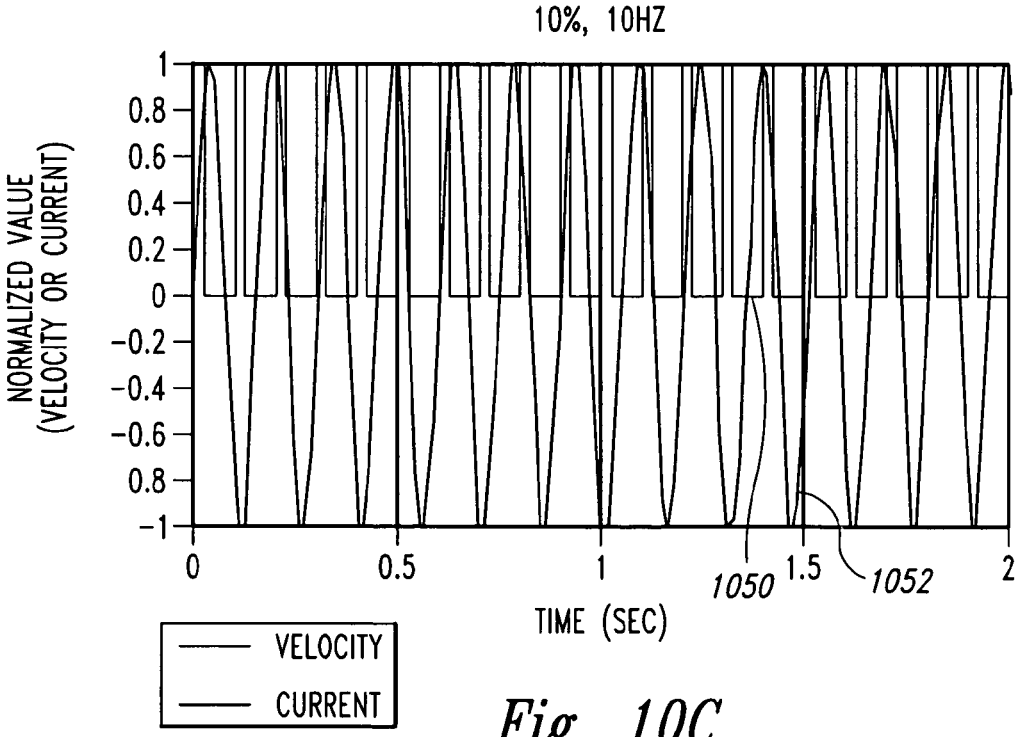
FIG. 10C is a graph illustrating another application of current pulsing relative to agitator motion.

FIG. 10B illustrates an example in which the agitator is oscillated at a frequency and the current is pulsed to the electrode at a first waveform having a first duty cycle (e.g., 5 Hz at 50% duty cycle). FIG. 10C is a graph illustrating another application in which current is pulsed according to a second waveform (e.g., 10 Hz at a 20% duty cycle). Compared to a direct current continuously applied to the electrode, the current pulsing shown in FIG. 10B may adversely increase the nonuniformities while the current pulsing shown in FIG. 10C may reduce nonuniformities. Therefore, the method 1000 provides selecting the current pulsing in correlation to the structure and movement of the agitator to improve the uniformity of plating processes.

From the foregoing, it will be appreciated that specific embodiments of the invention have been described herein for purposes of illustration, but that various modifications may be made without deviating from the spirit and scope of the invention. For example, the dividers in any of the foregoing embodiments can have different heights across the diameter of the agitators, or the top portion of each divider can be a sharp edge having an inverted V-shaped apex in a plane normal to the length of the dividers. Additionally, the specific features of the foregoing embodiments can be combined in other combinations that are different than the specific embodiments disclosed above. Accordingly, the invention is not limited except as by the appended claims.

We claim:

1. A reactor with liquid agitation for processing a workpiece in a processing zone, comprising:

a vessel having a flow system configured to direct a flow of processing liquid in the vessel;

an agitator having a base including a plurality of spaced apart ribs, with substantially each rib having sidewalls joined to a floor, and with a compartment formed between adjacent ribs, with an opening in the floor of each compartment, and with substantially each compartment having a width between adjacent ribs greater than the width of the opening in the floor, and greater than the width of the ribs; and an actuator coupled to the agitator to move the base relative to the workpiece.

2. The reactor of claim 1 wherein the base comprises a plate and the sidewalls are perpendicular to the floor.

3. The reactor of claim 1 wherein in substantially each compartment, the floor has a V-shaped cross section centered over the opening.

4. The reactor of claim 1 wherein the ribs are configured to induce trailing vortices within the compartments as the actuator reciprocates the agitator back and forth along an axis transverse with respect to a longitudinal dimension of the ribs, and the compartments are configured to confine the trailing vortices within the processing zone.

5. The reactor of claim 1 wherein the base comprises a porous plate.

6. The reactor of claim 1 wherein the base has a perimeter region with a first thickness and a medial region with a second thickness different than the first thickness.

7. The reactor of claim 1, further comprising a plurality of electrodes in the vessel and a plurality of independent power supplies operatively coupled to corresponding electrodes, wherein the power supplies are configured to apply different electrical potentials to different electrodes.

8. The reactor of claim 1 wherein the flow system includes a cross-flow assembly for directing a flow of processing solution along a longitudinal dimension of the ribs.

9. The reactor of claim 1 further comprising a control system having a non-transitory computer operable medium containing instructions that cause the actuator to move the agitator with non-uniform strokes.

10. The reactor of claim 9 wherein the instructions of the computer operable medium cause, the actuator to move the agitator along a first stroke length and a second stroke length different than the second stroke length.

11. The reactor of claim 9 wherein the instructions of the computer operable medium cause the actuator to move the agitator along a first stroke at a first velocity and a second stroke at a second velocity different than the first velocity.

12. The reactor of claim 9 wherein the instructions of the computer operable medium cause the actuator to move the agitator along a first stroke length at a first acceleration and a second stroke length at a second acceleration different than the first acceleration.

13. The reactor of claim 1 further comprising at least one electrode in the vessel and a control system having a non-transitory computer operable medium containing instructions that modulate an electrical potential applied to the electrode while a workpiece is being processed.

14. The reactor of claim 1 further comprising a rotor for holding the workpiece and rotating the workpiece relative to the vessel.

15. The reactor of claim 1 wherein in one or more of the compartments, the opening in the floor has a width 20%-50% of the width of the compartment.

16. A reactor for electrochemical processing of workpieces, comprising:

a vessel having a processing zone;

a flow modulator having a plurality of moveable vortex compartments having an opening in a floor of the compartment, with the opening having a width equal to 20% to 50% of the width of the compartment, and with the compartments configured to confine vortices proximate to a horizontal workpiece; and an actuator coupled to the flow modulator to move the vortex compartments back and forth in a plane generally parallel to the workpiece.

17. The reactor of claim 16 wherein the flow modulator comprises a plate and a plurality of dividers spaced apart from one another across the plate such that the plate and the dividers form three-sided moveable vortex compartments.

18. The reactor of claim 16 wherein the flow modulator comprises a plate, a plurality of elongated partitions spaced apart from one another across the plate, and a plurality of planar floors between the elongated partitions such that the partitions and the floors define individual moveable vortex compartments.

19. The reactor of claim 16 wherein the flow modulator comprises a plate and a plurality of dividers spaced apart from one another across the plate such that the dividers are configured to induce trailing vortices within the vortex compartments as the agitator oscillates in the processing zone.

20. The reactor of claim 16, further comprising an electrode in the vessel and a rotating workpiece holder having a plurality of electrical contacts configured to engage a perimeter portion of the workpiece.

21. The reactor of claim 16 wherein:

individual moveable vortex compartments have a first wall, a second wall, an intermediate section between the first and second walls, and an aperture in the intermediate section;

the reactor further comprises a plurality of electrodes in the vessel and a plurality of independently operable power supplies coupled to corresponding electrodes; and a controller including a non-transitory computer operable medium containing instructions that cause (a) the power supplies to apply different electrical properties to different electrodes and (b) the actuator to move the flow modulator non-uniformly.

22. A reactor for electrochemical processing of workpieces, comprising:

a vessel having a processing zone through which a processing fluid can flow to process a workpiece;

a flow modulator including a plate having a plurality of spaced apart three-sided channels and a plurality of elongated openings in the plate, with each elongated opening aligned with and extending into one of the channels;

an actuator coupled to the flow modulator to move the channels relative to the processing zone;

at least a first electrode in the vessel;

a first ring shield between the flow modulator and the workpiece; and a second ring shield in the vessel below the flow modulator.

23. A reactor for processing a workpiece, comprising:

a vessel having a flow system configured to direct a flow of processing liquid in the vessel;

an agitator having a plate and a plurality of spaced apart elongated partitions on the plate forming elongate compartments in the plate;

an opening in a sloped floor in substantially each of the elongate compartments; and an actuator coupled to the plate to move the plate relative to the workpiece.

24. A reactor for processing a workpiece, comprising:

a vessel having a processing liquid flow system;

an agitator having a base and a plurality of spaced apart dividers forming moveable compartments in the base;

the base having a perimeter region with a first thickness and a middle region with a second thickness different than the first thickness; and an actuator coupled to the agitator to move the base.

25. A reactor for processing a workpiece, comprising:

a vessel having a processing liquid flow system;

an agitator having a base and a plurality of spaced apart dividers forming compartments in the base;

an actuator coupled to the agitator to move the base;

a control system having a non-transitory computer operable medium containing instructions that cause the actuator to move the agitator along non-uniform strokes;

and the instructions of the computer operable medium cause the actuator to move the agitator along a first stroke length at a first acceleration and a second stroke length at a second acceleration different than the first acceleration.

* * * * *